US010822883B2

(12) United States Patent
Basile et al.

(10) Patent No.: US 10,822,883 B2
(45) Date of Patent: Nov. 3, 2020

(54) MOBILE DRILLING APPARATUS FOR A DRILLING SITE WITH CLUSTER OF WELLS AND METHOD OF ASSEMBLING AND MOVING THEREOF

(71) Applicant: DRILLMEC INC., Houston, TX (US)

(72) Inventors: Adolfo Basile, The Woodlands, TX (US); Andrea Tiberi, Magnolia, TX (US)

(73) Assignee: DRILLMEC INC., Houston, TX (US)

( * ) Notice: Subject to any disclaimer, the term of this patent is extended or adjusted under 35 U.S.C. 154(b) by 221 days.

(21) Appl. No.: 15/966,894

(22) Filed: Apr. 30, 2018

(65) Prior Publication Data

US 2019/0106945 A1 Apr. 11, 2019

(30) Foreign Application Priority Data

Oct. 6, 2017 (IT) ..... 102017000112182

(51) Int. Cl.

| | |
|---|---|
| ***E21B 15/00*** | (2006.01) |
| ***E21B 7/02*** | (2006.01) |
| ***E04H 12/34*** | (2006.01) |
| *E21B 19/00* | (2006.01) |

(52) U.S. Cl.

CPC ..... *E21B 15/003* (2013.01); *E04H 12/345* (2013.01); *E21B 7/02* (2013.01); *E21B 7/023* (2013.01); *E21B 19/008* (2013.01)

(58) Field of Classification Search

CPC ..... E21B 15/003; E21B 15/00; E21B 7/02; E21B 7/023; E21B 19/008; E21B 19/06; E21B 1/355; E21B 3/025; E04H 12/345; E04H 12/34

See application file for complete search history.

(56) References Cited

U.S. PATENT DOCUMENTS

| | | | | |
|---|---|---|---|---|
| 2003/0172599 | A1 | 9/2003 | Frink | |
| 2009/0218139 | A1 | 9/2009 | Donnally et al. | |
| 2013/0269268 | A1 | 10/2013 | Thiessen et al. | |
| 2015/0114717 | A1 | 4/2015 | Fortson et al. | |
| 2015/0135607 | A1* | 5/2015 | Ferrari | E21B 15/00 52/119 |
| 2017/0350153 | A1* | 12/2017 | Reddy | E04H 12/345 |

OTHER PUBLICATIONS

Italian Search Report from Italian Patent Application No. 10-2017-000112182, dated May 24, 2018.

* cited by examiner

*Primary Examiner* — George S Gray
(74) *Attorney, Agent, or Firm* — Merchant & Gould P.C.

(57) ABSTRACT

A mobile well drilling apparatus for a drilling site with clustered wells includes a substructure. A mast includes hinging points and fixing points. The mast is hinged to the substructure via the hinging points, about which the mast rotates between a horizontal and a vertical position. A drill floor includes a first portion hinged to the mast, and a second portion fixed to the mast and moving integrally therewith; and a draw-works permanently installed on the substructure. The substructure includes first and second sub-bases. The sub-bases are parallel and spaced apart. The first portion of the drill floor includes a connection portion facing one of the sub-bases. The hinging points are connected to one of the sub-bases. In operation, the fixing points are connected to the opposite sub-base. Each sub-base includes hydraulic walking devices adapted to move the well drilling apparatus between the clustered wells on the drilling site.

19 Claims, 28 Drawing Sheets

MOBILE DRILLING APPARATUS FOR A DRILLING SITE WITH CLUSTER OF WELLS AND METHOD OF ASSEMBLING AND MOVING THEREOF

This application claims the benefit of Serial No. 10-2017-000112182, filed 6 Oct. 2017 in Italy and is incorporated herein by reference. To the extent appropriate, a claim of priority is made to the above disclosed application.

The present invention relates to a well drilling apparatus, which can be moved, and to an associated method of assembling and/or moving.

In particular, the present invention relates to a well drilling apparatus, in particular for land rig drilling, for exploration and extraction of fossil fuels, such as, for example, oil or fuel gas, in particular a mobile well drilling apparatus particularly suitable for a drilling site for drilling wells, the latter being clustered wells.

Such a well drilling apparatus comprises walking devices adapted to move the entire well drilling apparatus between the clustered wells on the drilling site.

Furthermore, the well drilling apparatus according to the present invention can switch from an assembling configuration to an operating configuration, and vice versa, by means of a hydraulic actuator device, with a single, continuous and rapid movement.

Mobile well drilling apparatuses are known which comprise a substructure. Normally said substructure comprises sub-bases lying on the ground. The substructure is adapted to support a drill floor and a mast. Said drill floor and said mast, which is arranged in a vertical position, are raised to a given height above ground.

The drill floor normally comprises several devices, such as: at least one pair of power tongs, a rotary table, a draw-works, which are typically used during the drilling phases. The specific operation and intrinsic characteristics of said devices comprised in the drill floor are per se known to the person skilled in the art.

Normally, when switching from an assembling configuration to an operating configuration, a first step is carried out during which the mast is raised vertically, with the drill floor kept substantially at ground level. Subsequently the drill floor is raised to the desired height, the rotary table is positioned over the wellbore, aligned therewith, and the mast is held vertical over the drill floor. Therefore, when switching from the assembling configuration to the operating configuration, it is necessary to carry out two successive steps, in particular a first step of raising the mast from the horizontal position, parallel to the ground, to the vertical position, and a next step of lifting the drill floor.

The step of raising the mast is executed by using the draw-works, which exerts the necessary lifting force, in particular a pulling force. Normally, when the mast is in the horizontal position, two feet of the mast are hinged to the drill floor, and then, when the mast has been brought into the vertical position, also the remaining two feet are secured to the drill floor.

In the second step, the drill floor, on which the mast rests in the vertical position, is in turn lifted to the desired height above the wellbore, so that two distinct and independent movements are made.

In the prior art, before the well drilling apparatus is raised, the substructure, the drill floor and the mast are assembled at ground level and interconnected. Moreover, the fast line from the draw-works is inserted in the pulleys of the crown block, placed at the top of the mast, and inserted in the pulleys of the travelling block, thus becoming the drilling line. Said line is fixed at a first end, or deadline, to the corresponding deadline anchor.

Rig-up systems are also known wherein the mast is raised by exerting a thrust force in order to raise the mast in the vertical position.

Furthermore, although the second movement for lifting the drill floor, on which the mast has been arranged in the vertical position, occurs by means of a thrust force exerted on the drill floor and/or on the mast, the two movements are independent and wholly non-correlated.

The use of hydraulic actuators ensures shorter rig-up times because it is no longer necessary to install a frame for the idler pulleys and the sling lines for lifting the well drilling apparatus. Moreover, the use of hydraulic actuators allows the lifting operation to be effected by using a low-power hydraulic unit, possibly with a diesel or electric motor. This avoids the need for starting the yard generators to supply power to the draw-works.

In the present state of the art, there is a tendency to move large well drilling apparatuses with all the accessory equipment necessary for the operation of a drilling rig, which must however be moved from one well to the next. In the prior art, in order to move a well drilling apparatus it is necessary to disassemble the well drilling apparatus. This requires disconnecting the auxiliary devices, lowering the mast from a vertical position to a horizontal position, moving the entire well drilling apparatus towards the next well, and finally reassembling everything and reconnecting the auxiliary structures.

Walking systems are also known which can move the well drilling apparatus and its accessory equipment on a drilling site with clustered wells. Such walking systems comprise actuators univocally associated with the substructure in order to properly move the entire apparatus and its accessory equipment along a given direction between the various wells on the drilling site without the need for raising and lowering the drill floor and/or the mast.

In oil exploration drilling, extraction maximization requires very deep drilling in order to re-activate apparently exhausted oil wells. This has led to the construction of increasingly imposing, in terms of dimensions, power and weight, drilling structures.

In the current state of the art, well drilling apparatuses are being produced which have a power output of up to 3,000 HP or 2,300 kW, with a drill floor height above ground of about 17 ft or 11 meters, a maximum total height of 156 ft or 47.5 m, a hook load of 1,500,000 pounds or 681 tons, a rotary load of 1,300,000 pounds or 590 tons, and a setback load of 1,000,000 pounds or 454 tons.

Some manufacturers of well drilling structures are mainly developing movable 2,000 hp well drilling apparatuses of the type called "box substructure". This type of well drilling structure is characterized by high-power hydraulic lifting devices.

In order to rotate the set of drill pipes, a top drive is also normally employed. Said top drive can move along a vertical axis within the U-shaped structure of the mast. The set of pipes are thus rotated by said top drive, which also reduces the manual work normally required when adding pipes and the risk for the operators.

In order to speed up the mast raising operation, and consequently reduce the time necessary for installing the well drilling apparatus, it is advisable to associate the top drive with a portion of the mast already during the assembly stage. This solution makes transportation easier and reduces the assembly times. The top drive remains associated with the mast all the time, even after the rig-up operations or after the rig-down operations for transporting the apparatus towards the next well.

Well drilling apparatuses are also known wherein in a first assembling configuration the various components are assembled in a horizontal position, substantially at ground level, and subsequently said apparatus is raised and brought into a second operating configuration, in which the mast is vertical.

All the steps required for rigging up and/or down the well drilling apparatus, and in particular the mast and the substructure, are carried out by means of a hydraulic actuator device, which pushes said apparatus. While switching between the two configurations, pushed by said hydraulic actuator device, the well drilling apparatus makes a continuous movement in time, with no interruptions or intermediate positions. A well drilling apparatus is known from document WO2013168064 which can switch from a first assembling configuration to a second operating configuration, and vice versa. Such apparatus comprises a substructure, whereon said apparatus rests, a mast, hinged to said substructure, about which it can rotate to switch from said assembling configuration, which is substantially horizontal, to said operating configuration, and vice versa; a drill floor, which can be lifted up, and which is connected to the mast; an actuator device, adapted to allow the well drilling apparatus to switch between said configurations. The actuator device is a hydraulic device directly connected to the mast. The drill floor comprises a first portion, cantilevered relative to the mast, and a second portion, constrained to said mast and rotating integrally with it.

A draw-works is permanently installed on the substructure.

In order to be moved between the various wells, the apparatus described in the above-mentioned patent needs to switch from the second operating configuration to the first assembling configuration, so that it can be disassembled, moved and then correctly reassembled over the desired wellbore.

The present invention allows solving the problems of the above-described prior art by providing a well drilling apparatus wherein the apparatus, even a very big one, can rapidly switch from an assembling configuration, which is substantially horizontal, to an operating configuration, while also allowing the entire apparatus in the operating configuration to be moved on the drilling site with clustered wells.

One aspect of the present invention relates to a well drilling apparatus.

A further aspect of the present invention relates to a method of assembling the well drilling apparatus.

Finally, yet another aspect of the present invention relates to a method of moving.

The features and advantages of the well drilling apparatus and of the method of assembling and/or moving will become apparent in the light of the following description of at least one embodiment thereof and of the annexed drawings, wherein:

FIG. 1A shows an axonometric view of a mobile well drilling apparatus according to the present invention for a drilling site with clustered wells, ready for use; FIG. 1B shows a detail view of the lower portion of the mobile well drilling apparatus; and FIG. 1C shows a further detail view of the lower portion of the mobile well drilling apparatus;

FIGS. 2A and 2B show a top view of a drilling site with clustered wells, where a mobile well drilling apparatus according to the present invention has been installed. In particular, FIG. 2A shows the apparatus over a first well to be drilled; FIG. 2B shows the drilling apparatus over a second well, the latter being distinct from the first well, after the apparatus has been moved; FIG. 2C shows a detail view of a portion of the well drilling site of FIG. 2A; FIG. 2D shows a detail view of the well drilling site of FIG. 2B; and FIG. 2E shows a detail view of the cable and pipe management system;

Figure 1A:
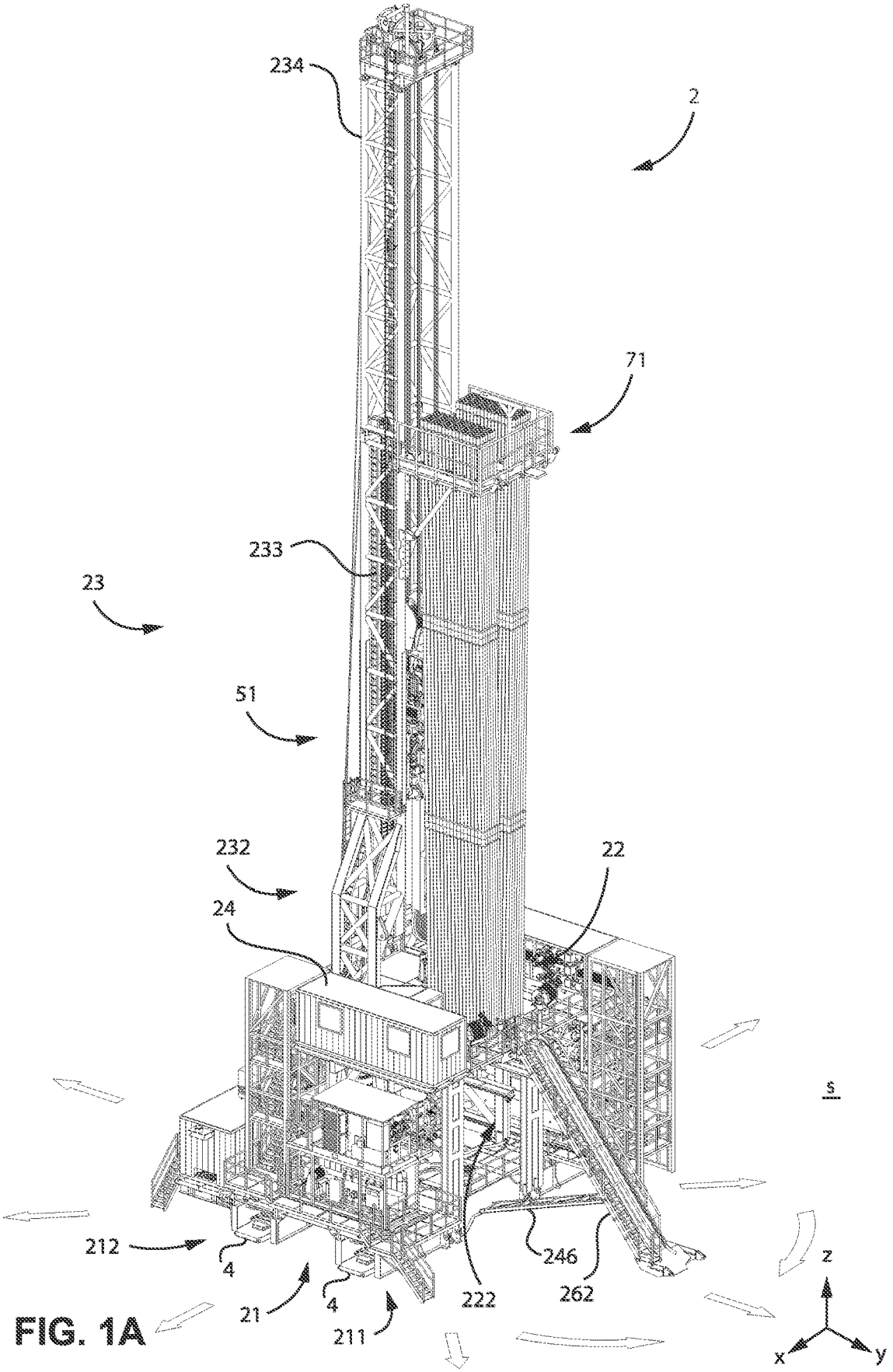
Figure 1B:
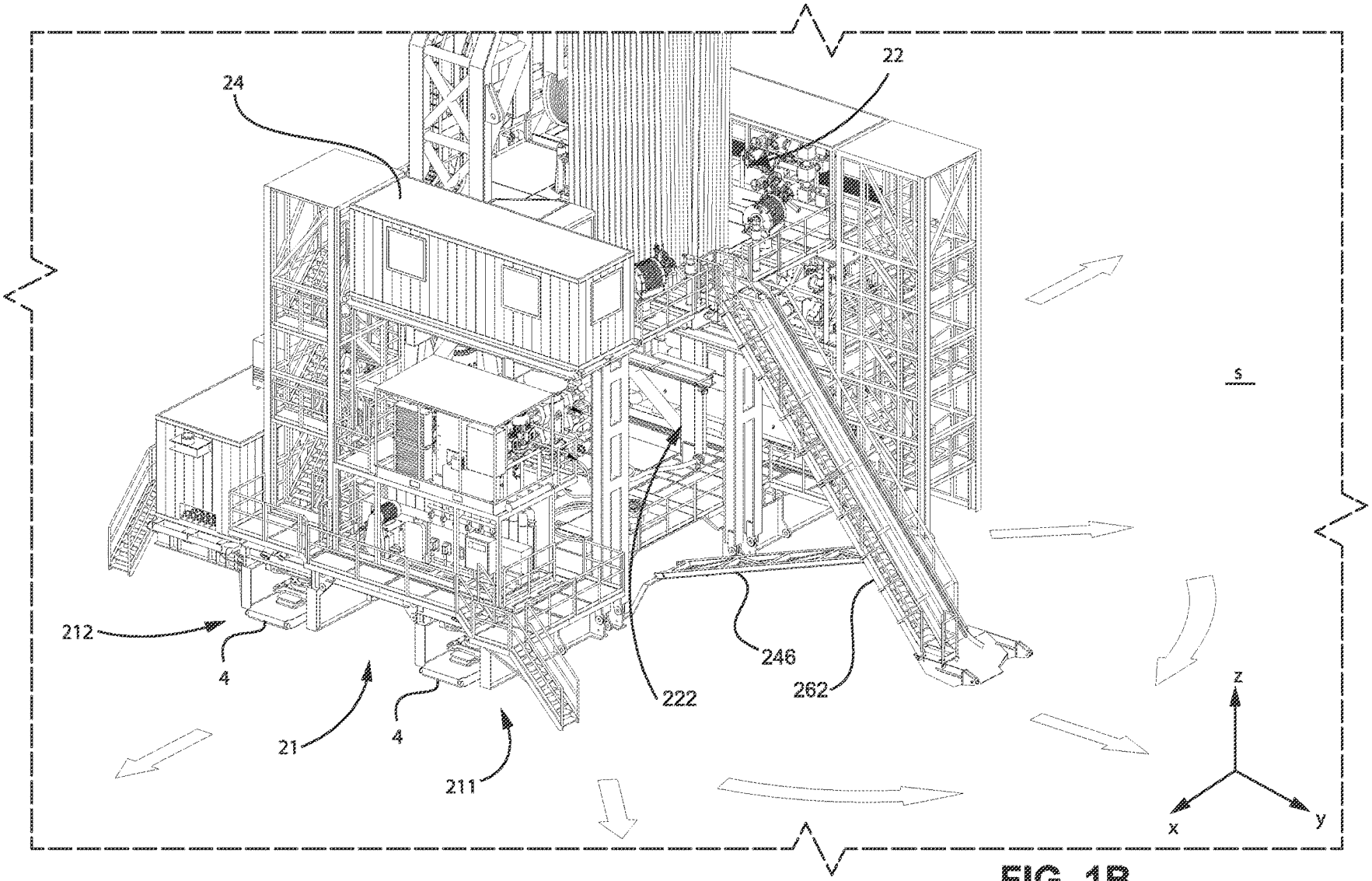
Figure 1C:
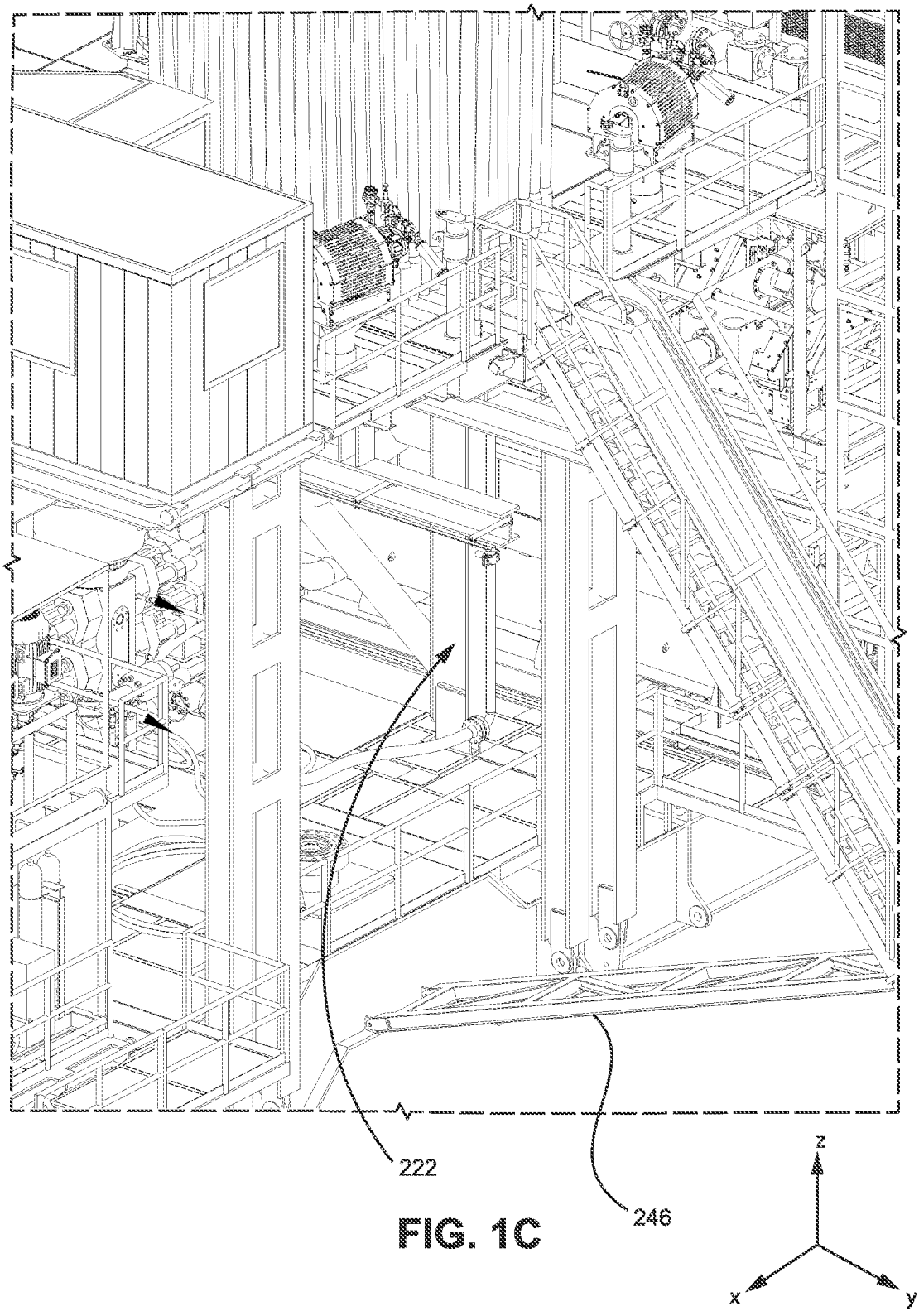
Figure 8A:
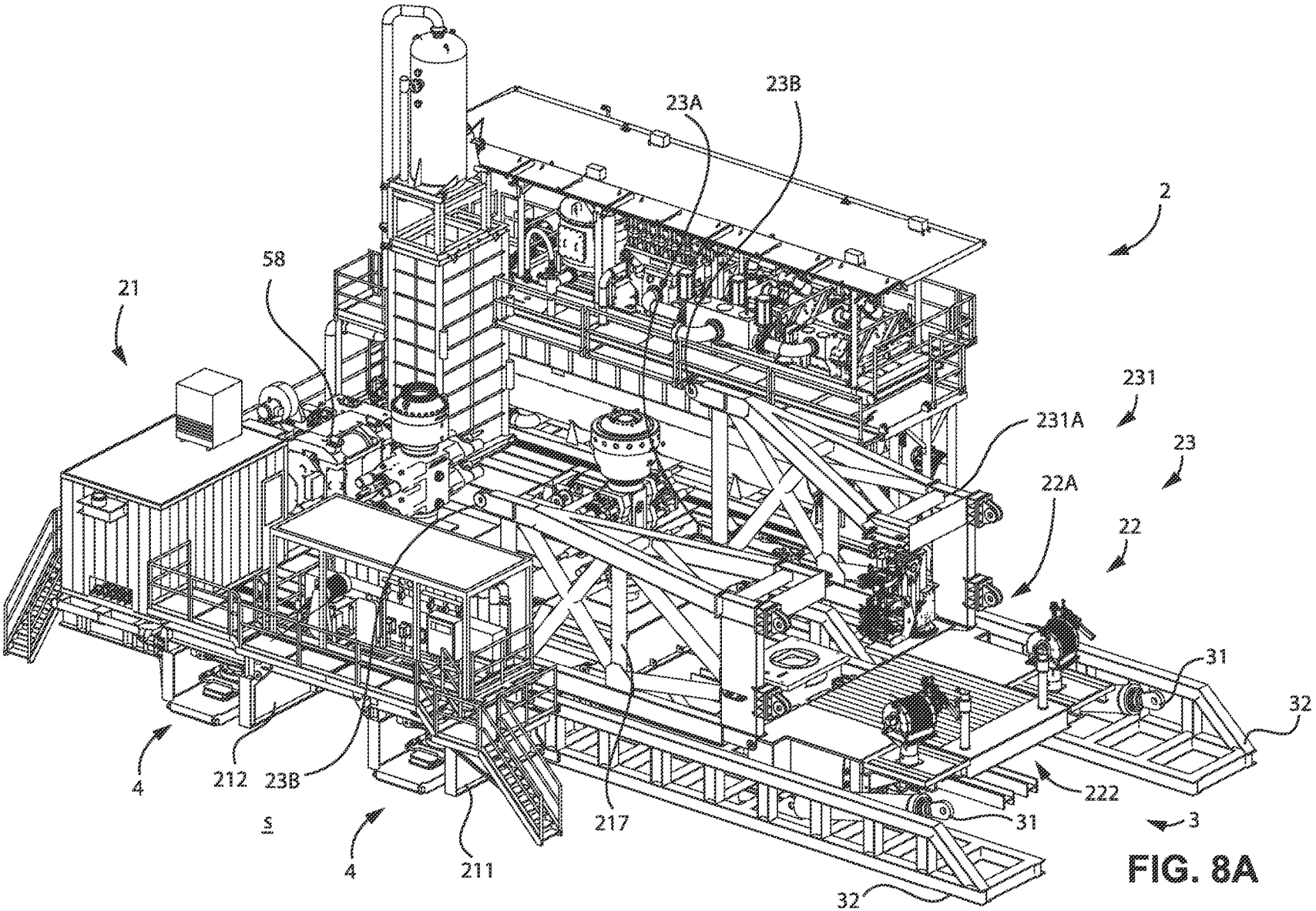
Figure 8B:
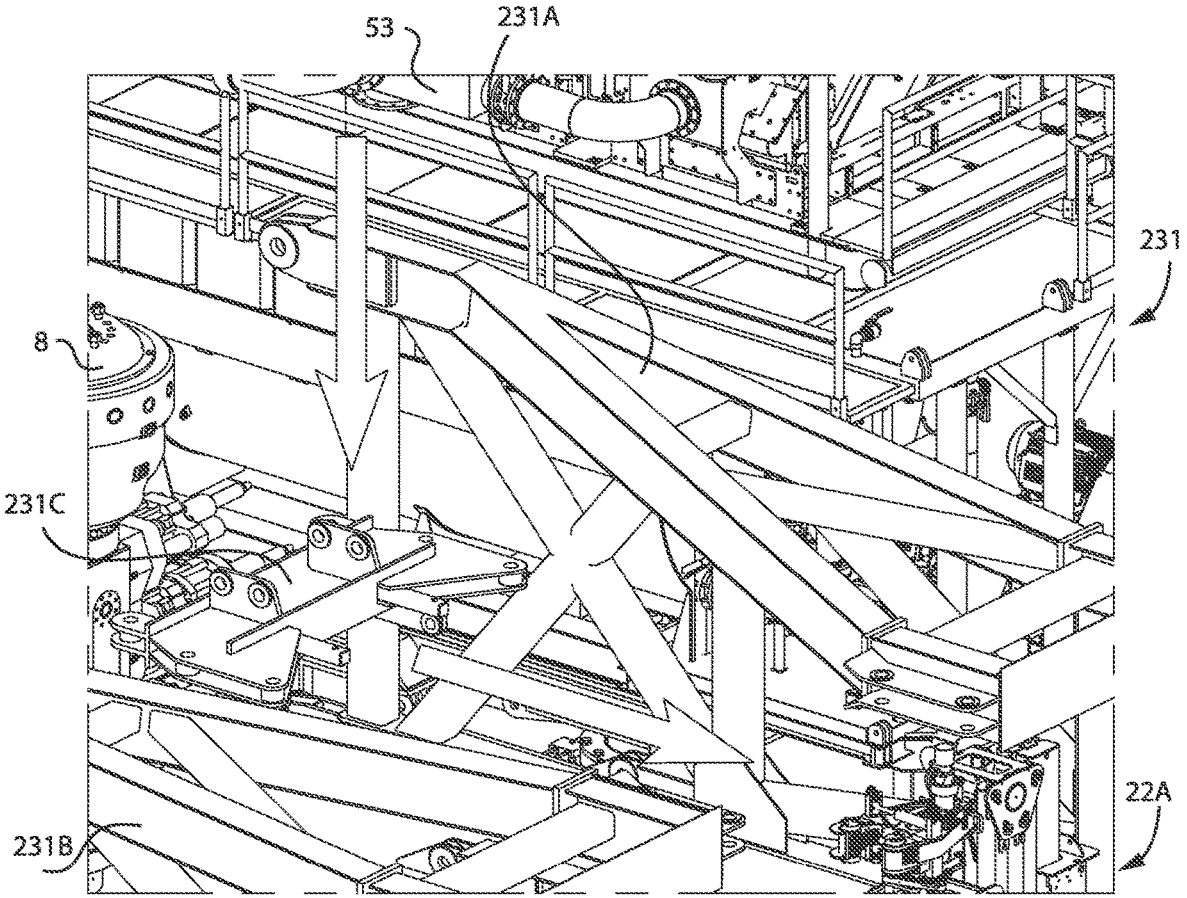
Figure 8C:
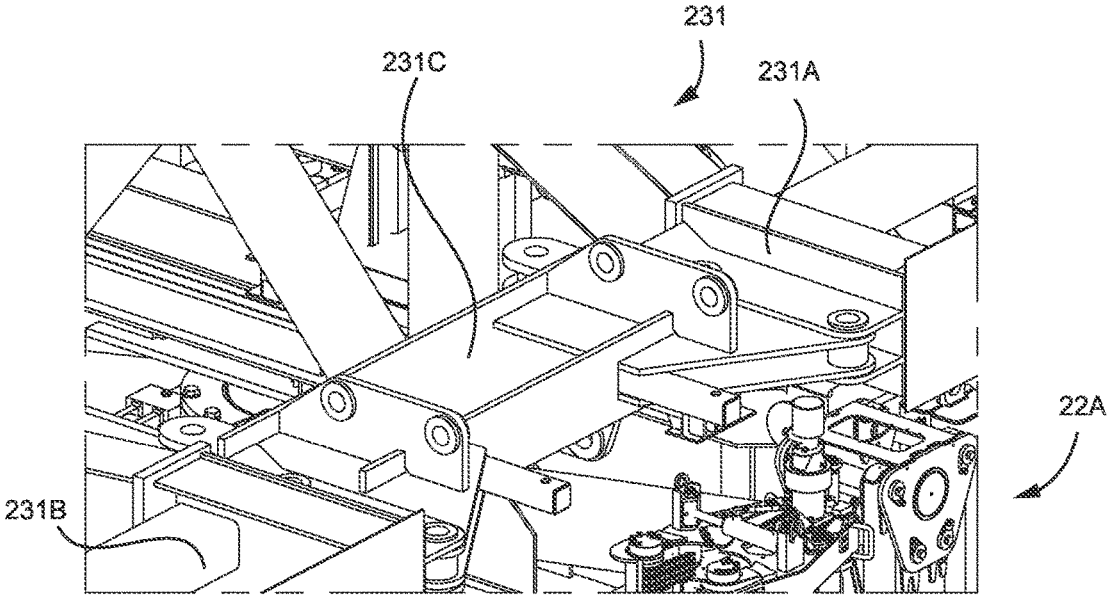
Figure 9:
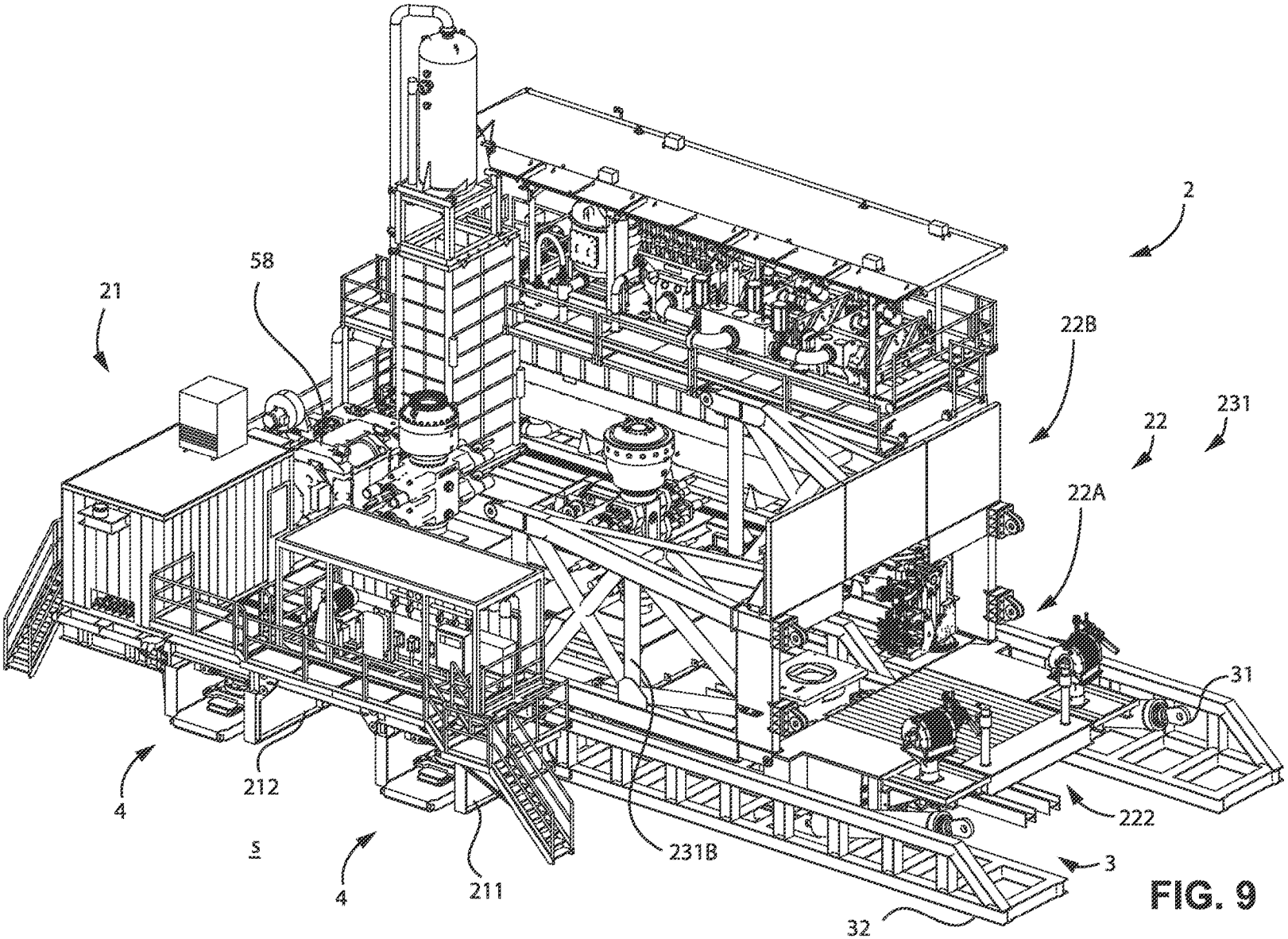
Figure 10:
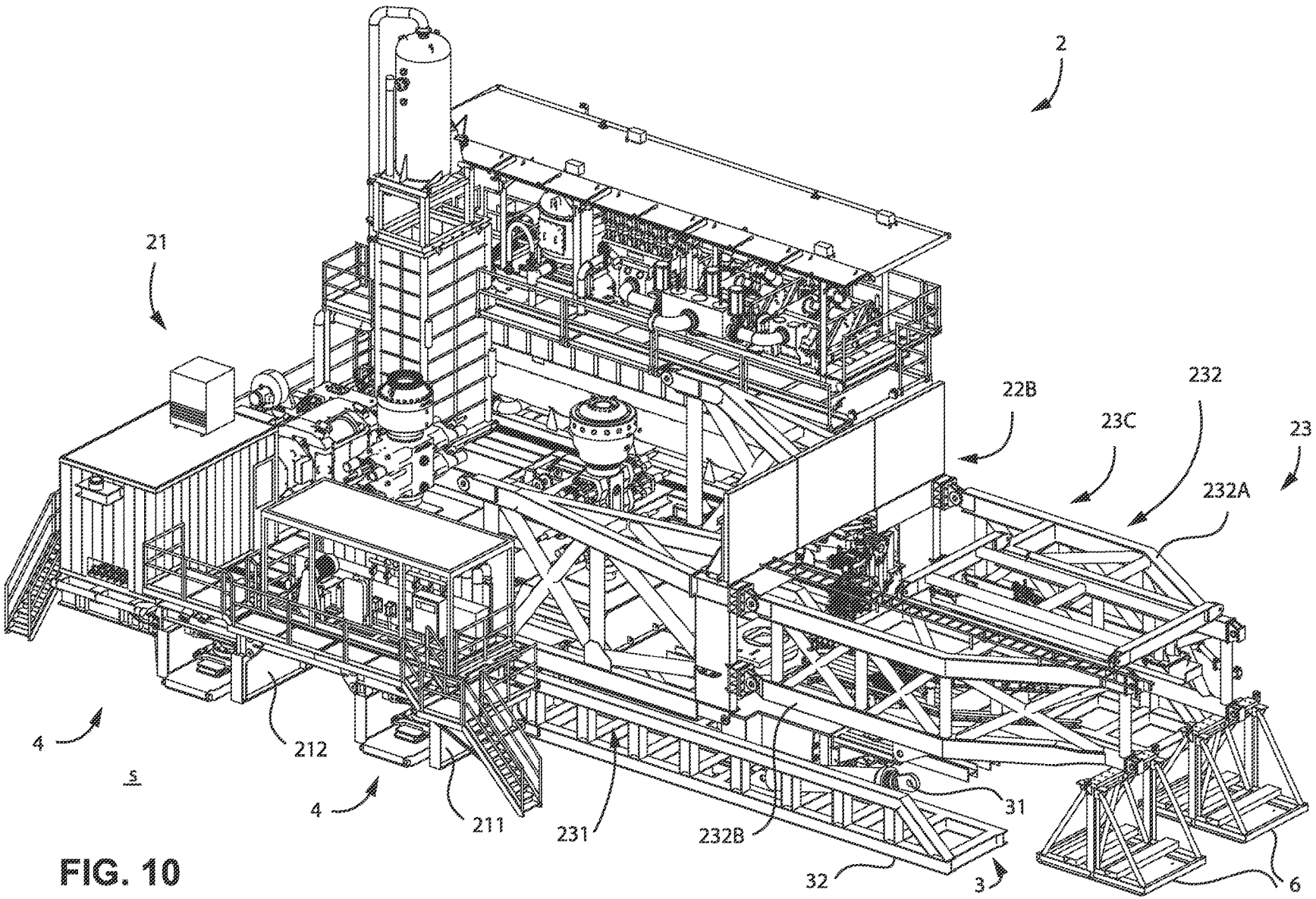
Figure 11:
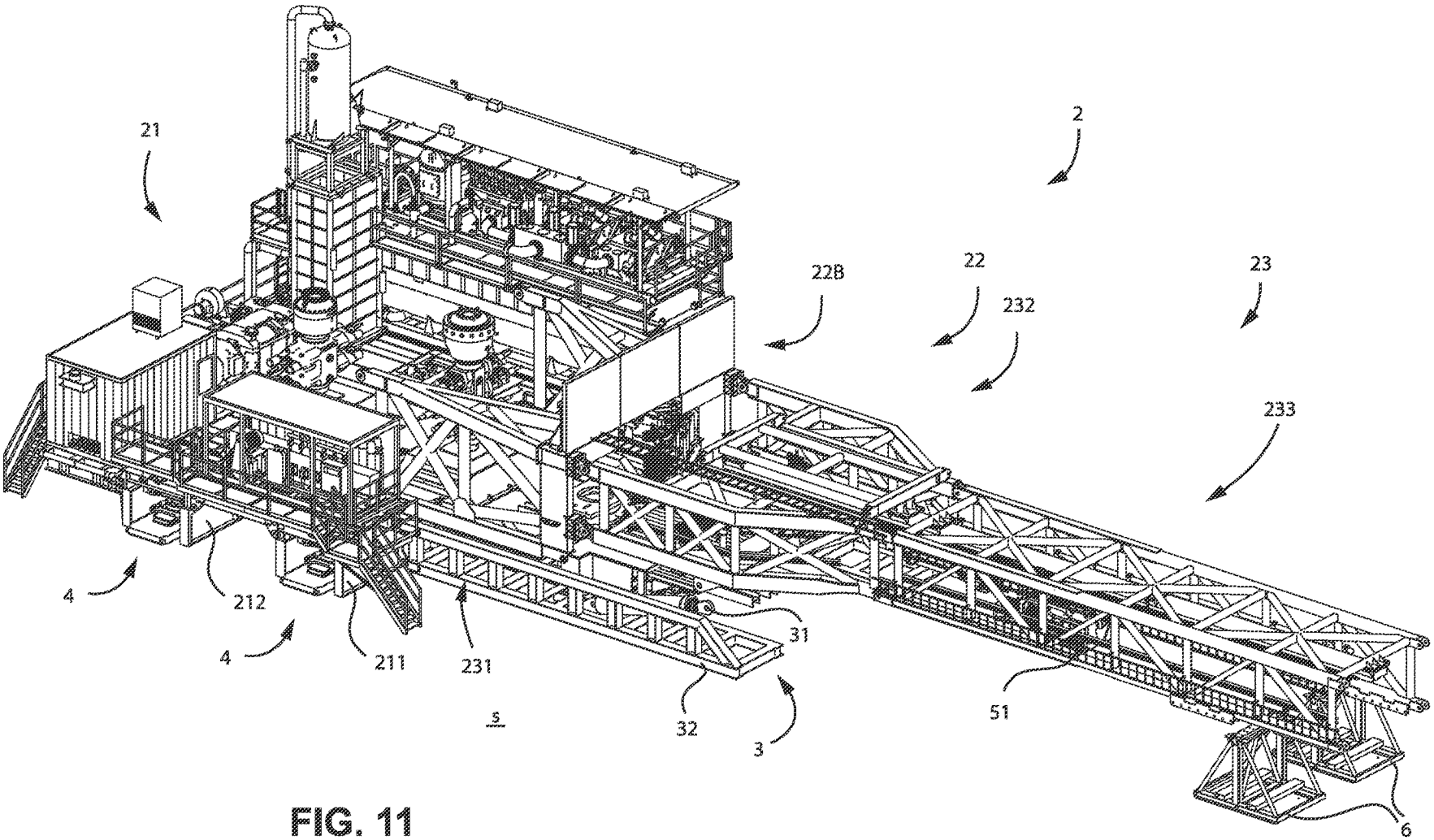
Figure 12A:
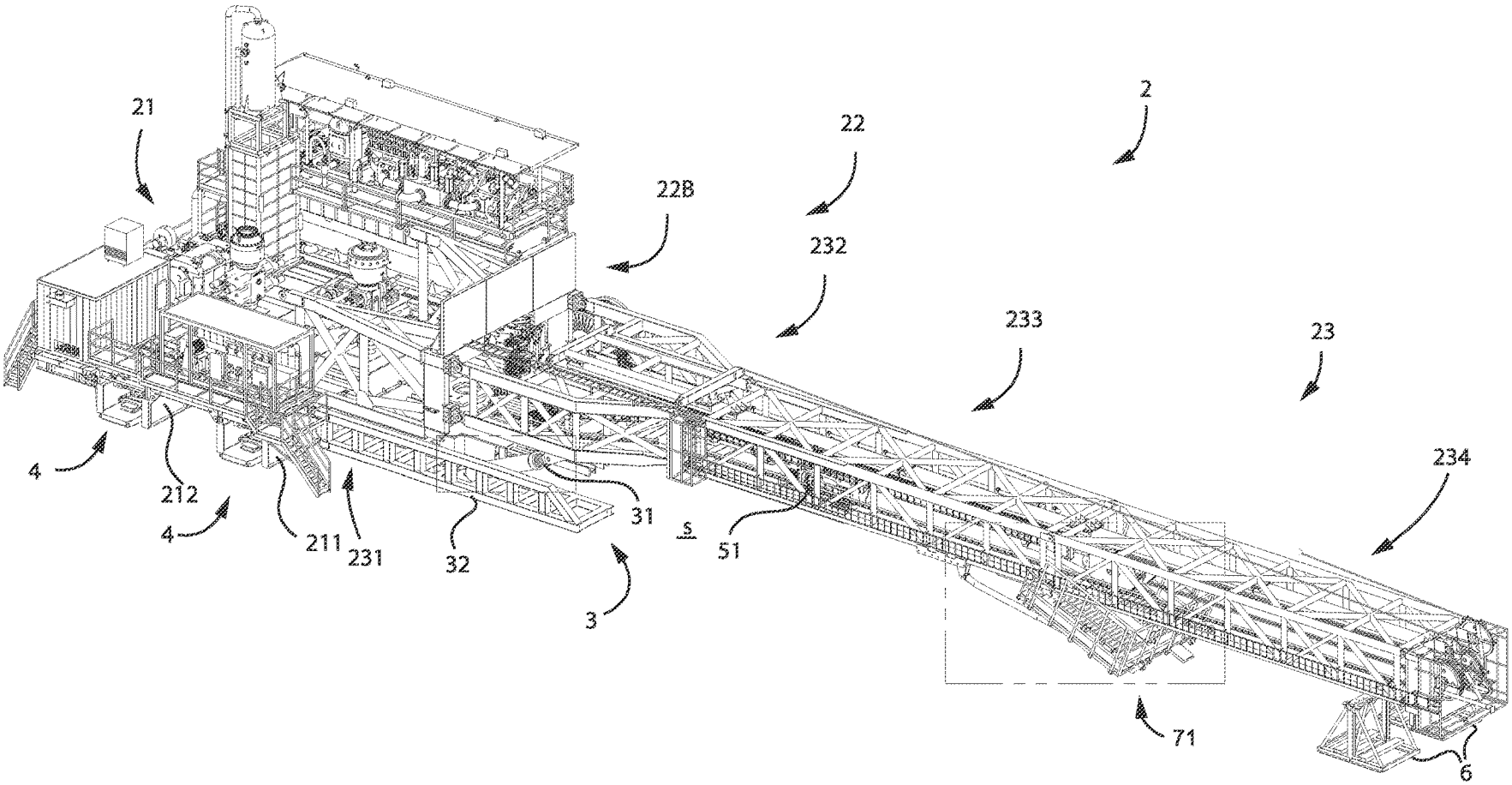
Figure 12B:
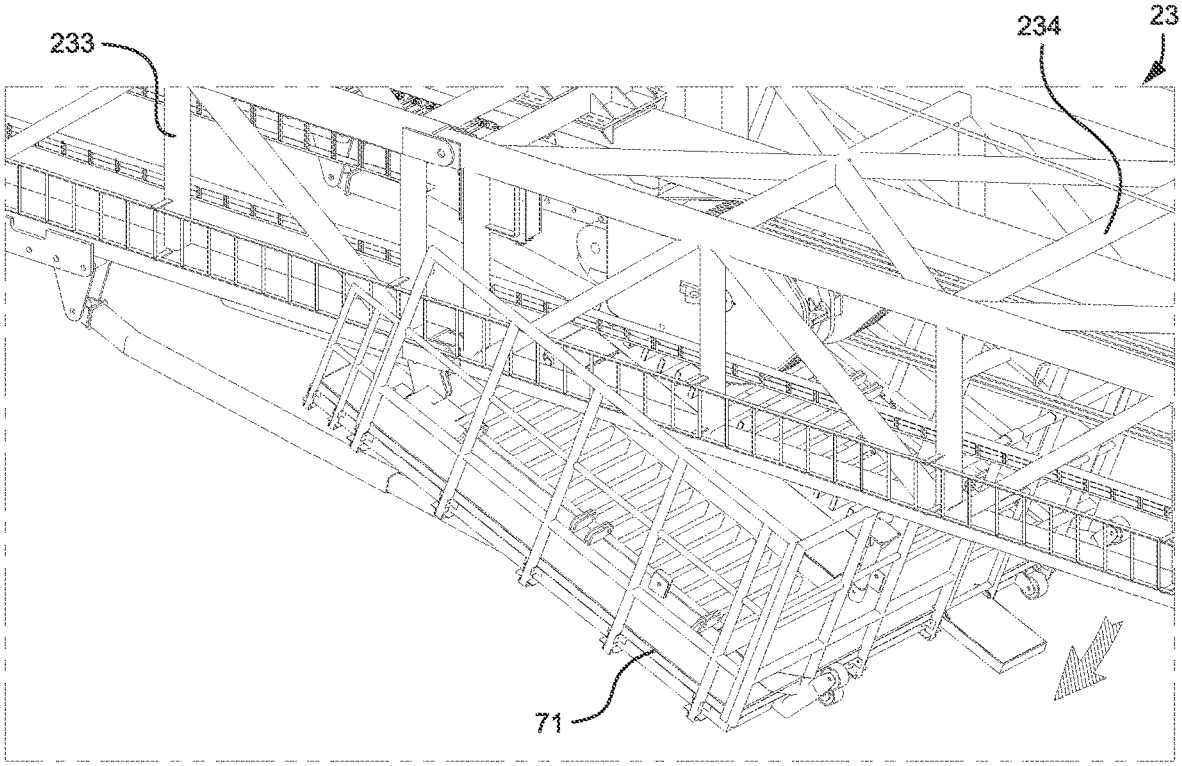
Figure 12C:
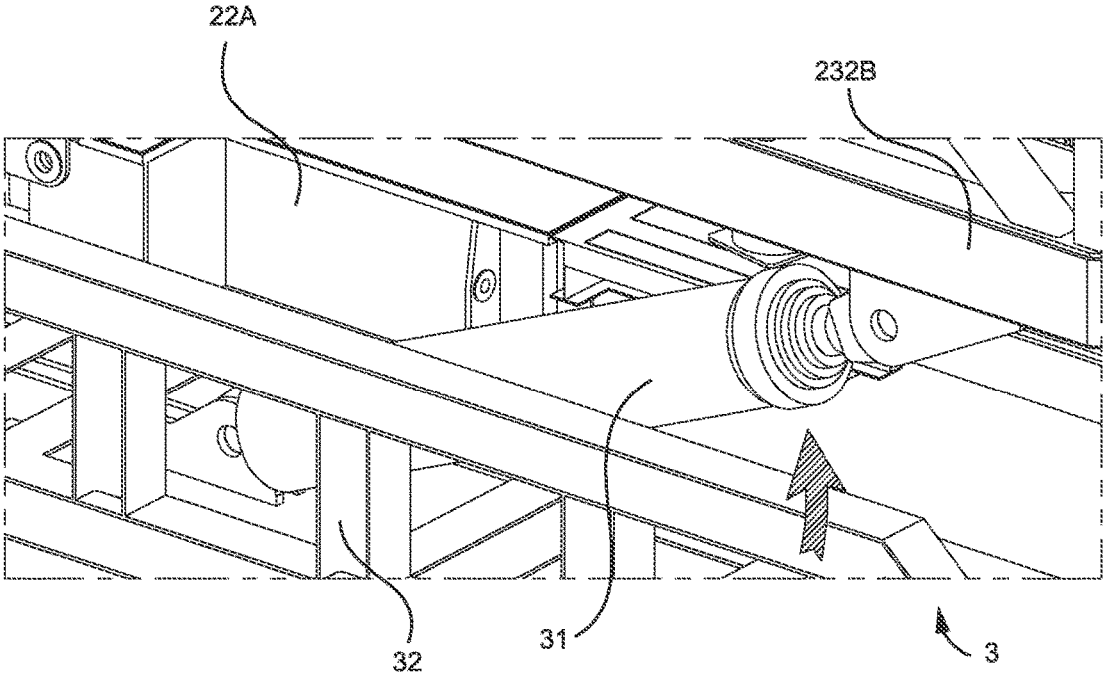
Figure 13A:
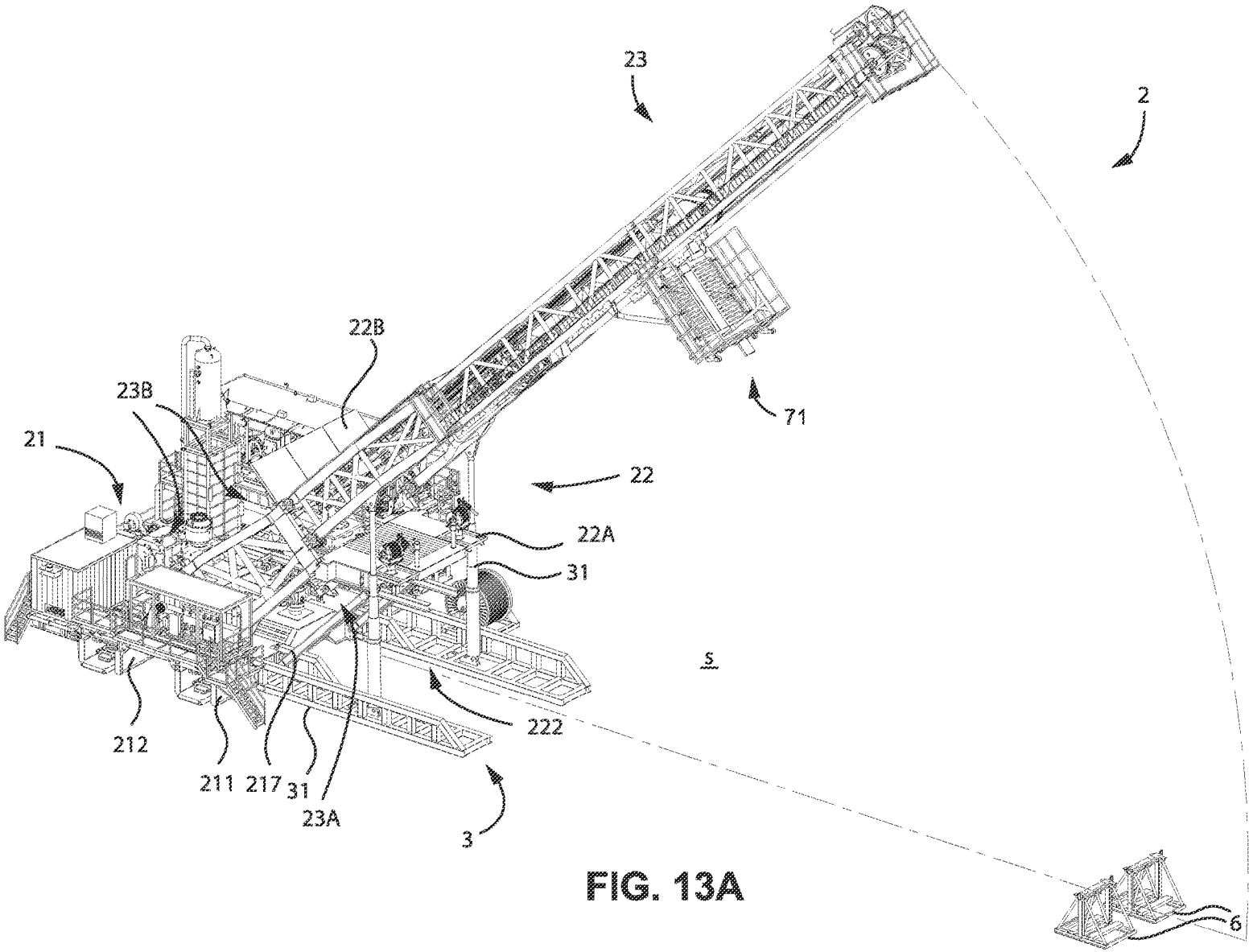
Figure 13B:
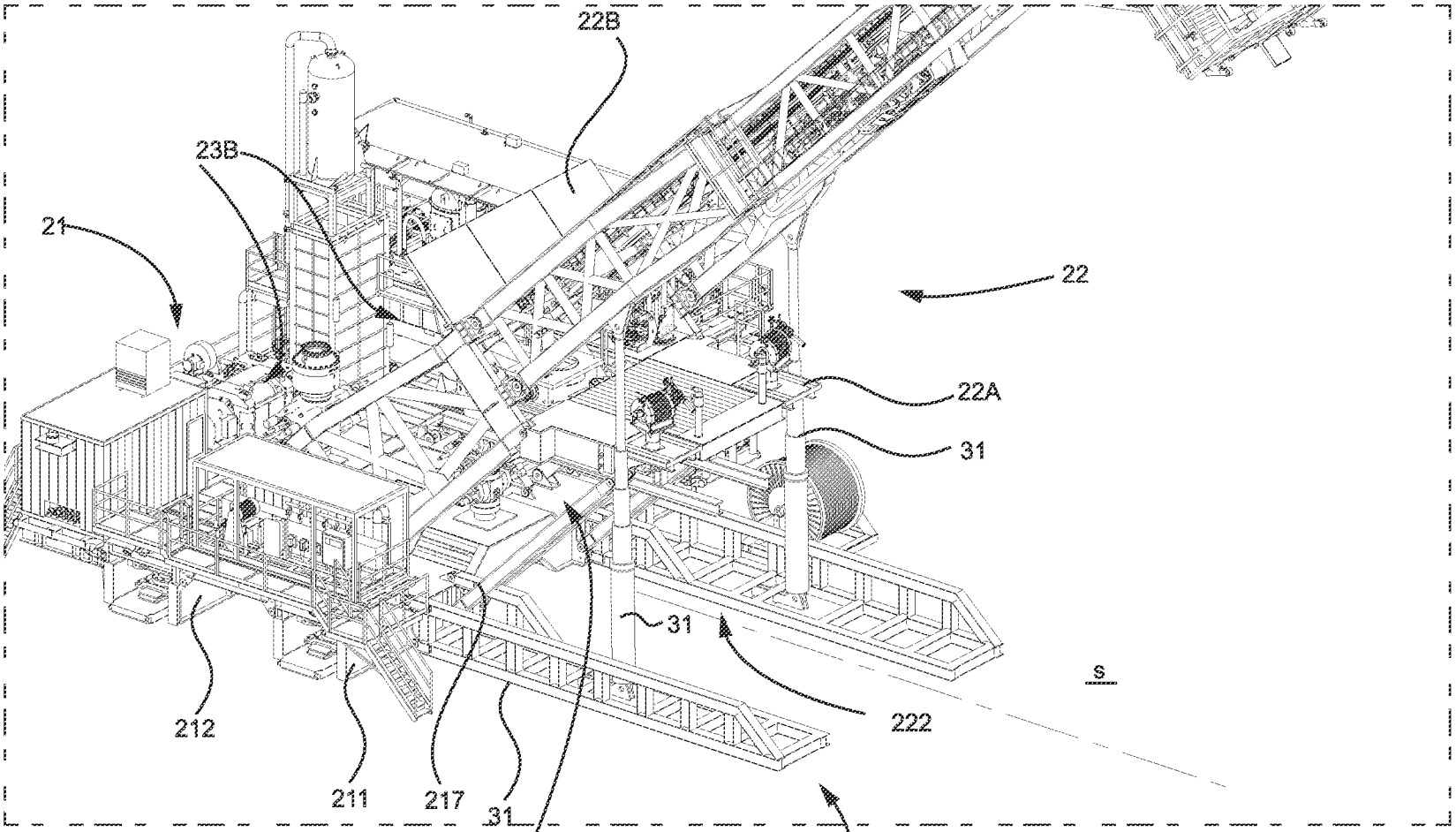
Figure 14A:
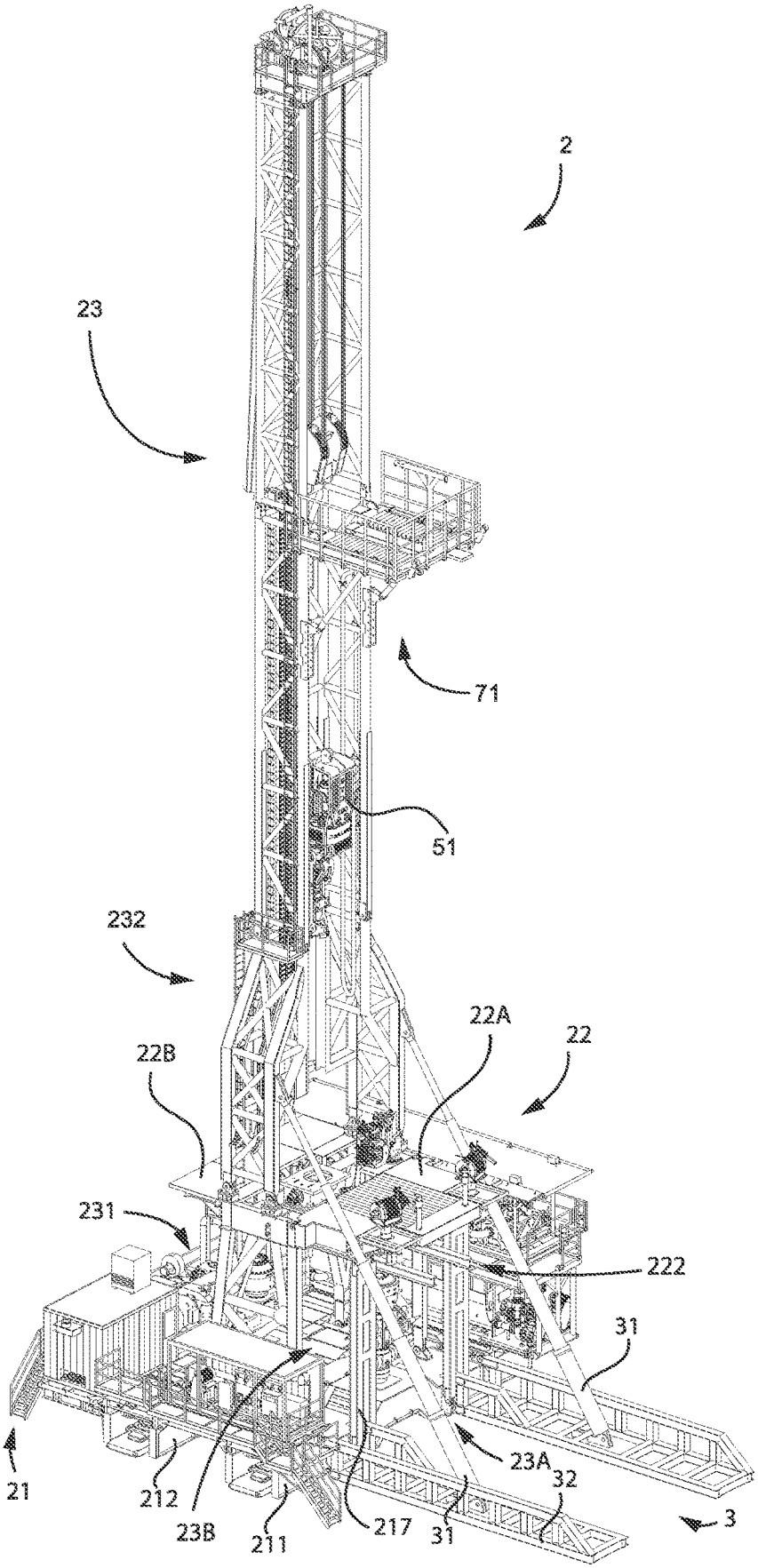
Figure 14B:
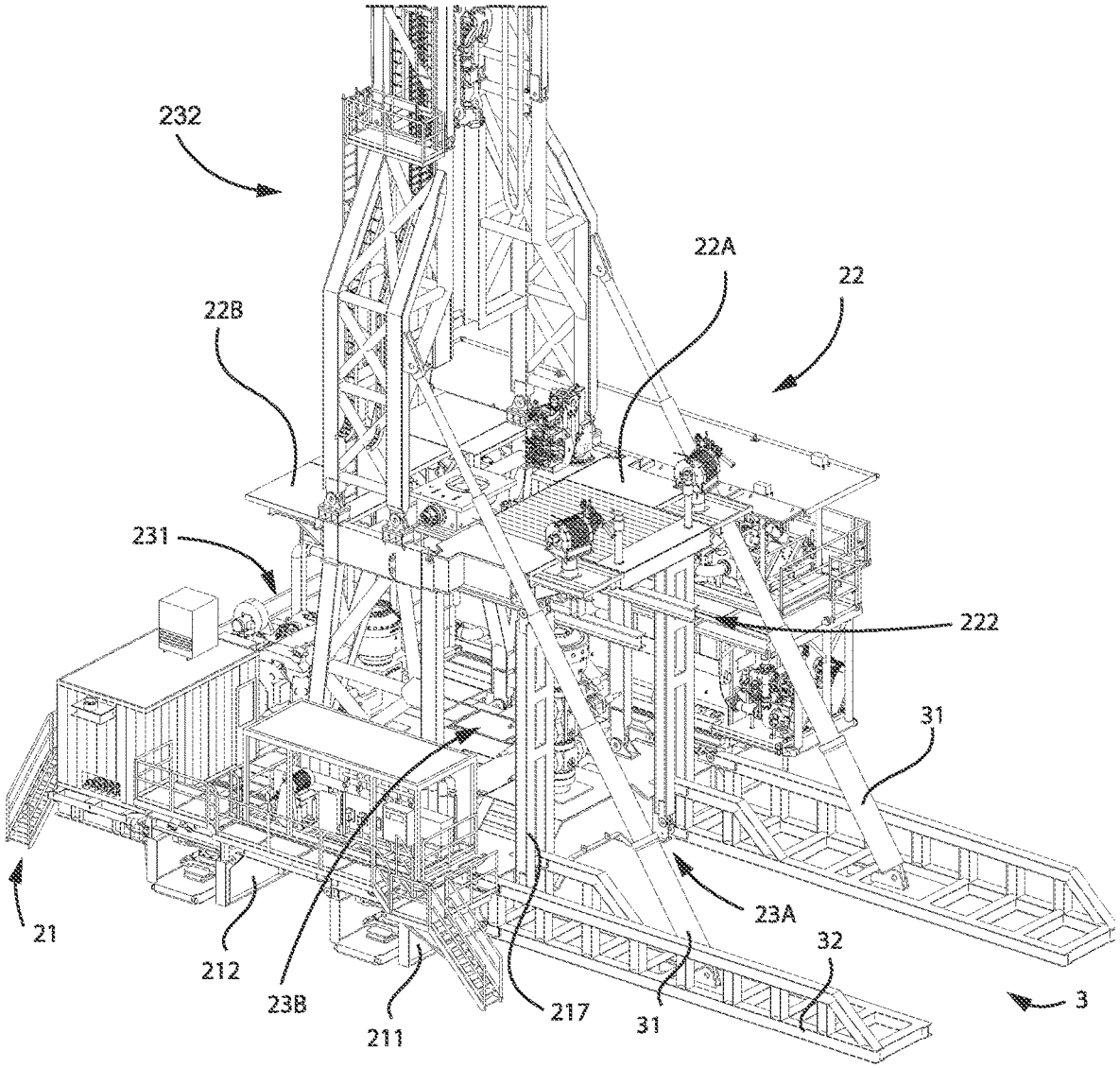
Figure 15A:
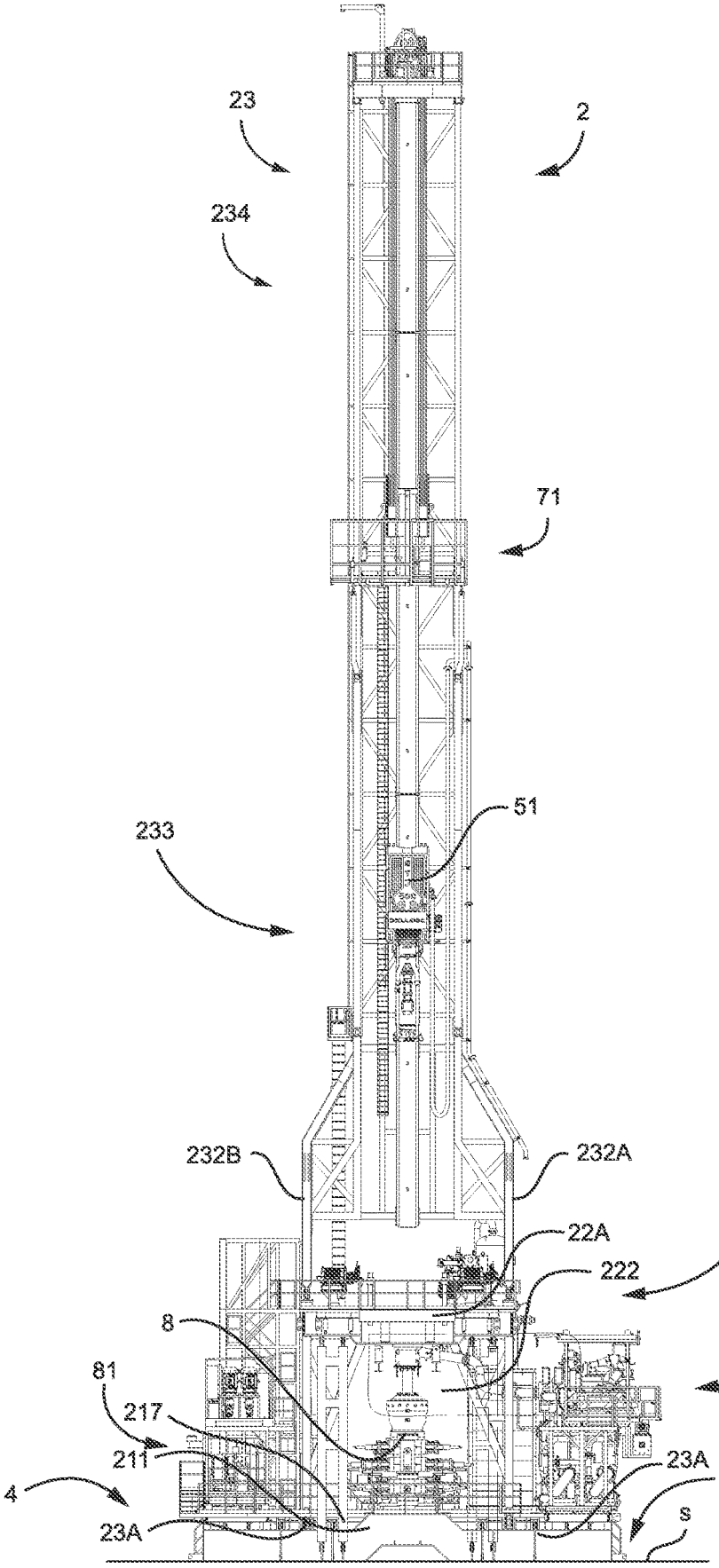
Figure 15B:
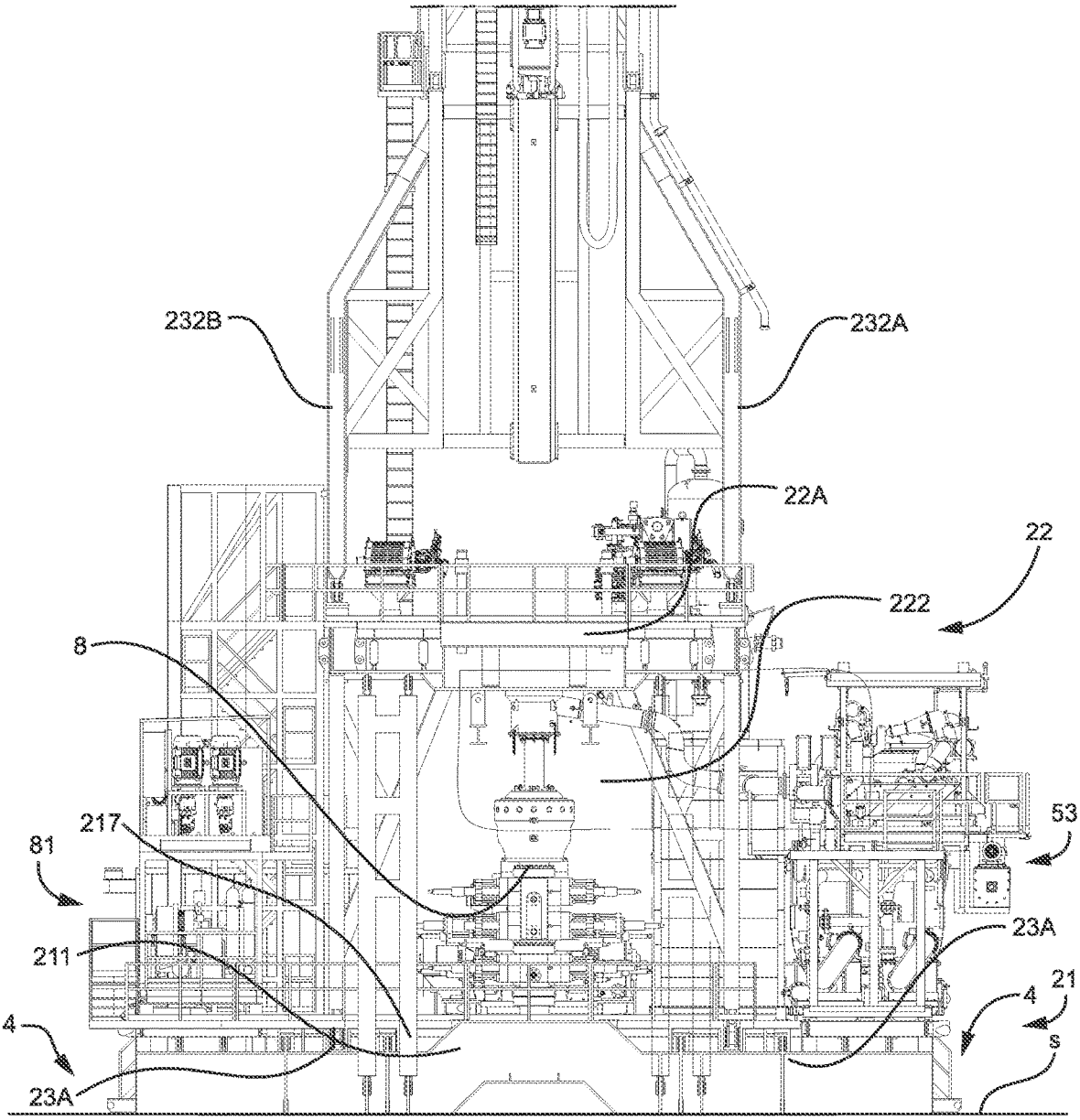
Figure 16A:
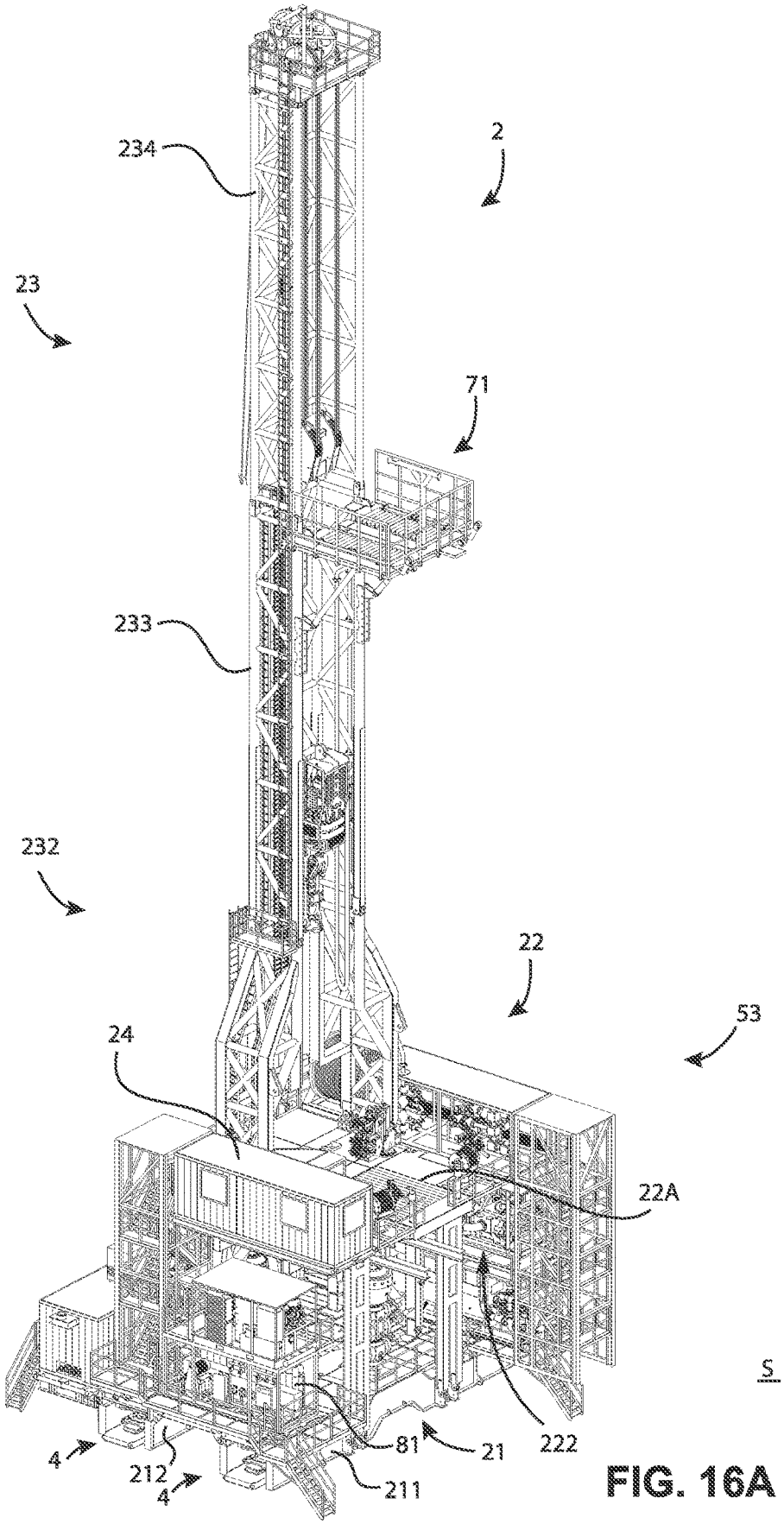
Figure 16B:
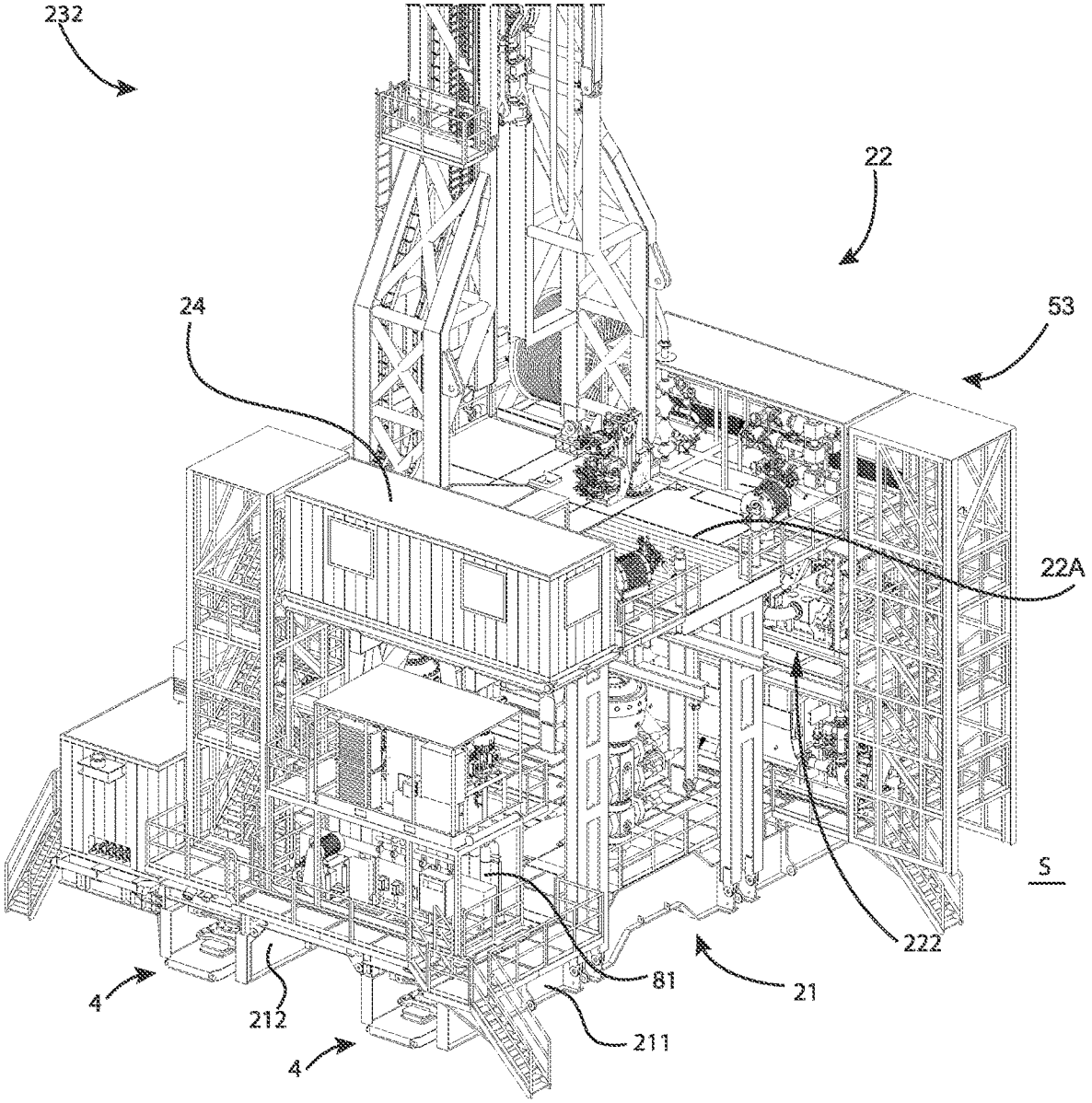

FIGS. 8A, 8B and 8C show some parts of the apparatus according to the present invention, wherein the right-hand and left-hand bottom sections of the mast are fixed to the substructure, in particular to the first sub-base; in particular, FIG. 8A shows a general view of the well drilling apparatus assembled up to this point; FIG. 8B shows a detail of the positioning of the connection structure adapted to connect the right-hand bottom section and the left-hand bottom section of the mast; FIG. 8C shows the connection structure appropriately fixed to the bottom sections of the mast;

FIG. 9 shows the partial assembling of the drill floor to the bottom section of the mast, and in particular the fixing of the second portion of the drill floor to the mast;

FIG. 10 shows the fixing of the right-hand and left-hand lower intermediate sections of the mast and the mutual connection thereof, effected by using suitable support stands;

FIG. 11 shows the fixing of the upper intermediate section of the mast, effected by using suitable support stands;

FIGS. 12A, 12B and 12C show some parts of the apparatus in which the top section of the mast is fixed; in particular, FIG. 12A shows a general view of the apparatus assembled up to this point; FIG. 12B shows a detail in which one can see the base for positioning the drill pipes, appropriately hinged to the mast structure; FIG. 12C shows a detail of the actuator device for raising the mast and the substructure;

FIG. 13A shows the apparatus in an intermediate configuration between the assembling configuration, in which the mast is substantially horizontal, and the operating configuration, in which it is substantially vertical; FIG. 13B shows a detail view of a portion the apparatus in the intermediate configuration;

FIG. 14A shows the apparatus in the operating configuration, in which the mast is substantially vertical; FIG. 14B shows a detail view of a portion the apparatus in the operating configuration;

FIG. 15A shows a front view of the apparatus in the operating configuration; FIG. 15B shows a front detail view of a portion the apparatus in the operating configuration;

FIG. 16A shows the apparatus in which the remaining equipment, devices, systems and/or plants have been assembled and appropriately fixed, in order to obtain the well drilling apparatus ready for use as shown in FIG. 1; FIG. 16B shows a detail view of lower portion of the apparatus of FIG. 16A.

With reference to the above-listed figures, the well drilling apparatus according to the present invention is designated as a whole by reference numeral 2. The well drilling apparatus is of the mobile type and is particularly suitable for use on a drilling site "S" having a plurality of clustered wells "W".

Well drilling apparatus 2 according to the present invention comprises: a substructure 21, which lies on the ground and supports well drilling apparatus 2; a mast 23. Said mast in turn comprises: hinging points 23*a*; and fixing points 23*b*.

Said mast 23 is hinged to said substructure 21 via said hinging points 23*a*. Said mast 23 rotates about said hinging points 23*a* in such a way as to move from a substantially horizontal position to a substantially vertical position during the switching of well drilling apparatus 2 from an assembling configuration to an operating configuration.

Well drilling apparatus 2 according to the present invention comprises also a drill floor 22. Said drill floor 22 in turn comprises: a first portion 22*a*, which is hinged to said mast 23; and a second portion 22*b*, which is rigidly fixed to said mast 23 and moves integrally with said mast 23.

Well drilling apparatus 2 according to the present invention further comprises a draw-works 58, which is permanently installed on substructure 21.

In the preferred, but non-limiting, embodiment, said substructure 21 comprises: a first sub-base 211 and a second sub-base 212.

Said first sub-base 211 and said second sub-base 212 are arranged parallel to each other and appropriately spaced apart, depending on the requirements and dimensions of well drilling apparatus 2.

Said first portion 22*a* of drill floor 22 comprises a connection portion 222 to which a ramp 262 of a catwalk 26 can be connected.

Said connection portion 222 faces towards one of the two sub-bases (211, 212).

In the preferred, but non-limiting, embodiment, said hinging points 23*a* of mast 23 are connected to one of said first sub-base 211 and said second sub-base 212. Moreover, in the operating configuration of well drilling apparatus 2 said fixing points 23*b* are respectively connected to that sub-base (212, 211) which is opposite to the sub-base to which said hinging points 23*a* of mast 23 are connected.

Preferably, in one embodiment said hinging points 23*a* are hinged to the first substructure by means of pins. In the same embodiment, said fixing points 23*b* are connected to the second sub-base 212 of substructure 21, when well drilling apparatus 2 is in the operating configuration.

In well drilling apparatus 2 according to the present invention, each one of the two sub-bases (211, 212) comprises at least one pair of walking devices 4, preferably of the hydraulic type.

Said walking devices 4 are adapted to move well drilling apparatus 2 between said clustered wells "W" that are present on drilling site "S". One possible embodiment of walking device 4 is described, for example, in patent document US2016297488A1, the contents of which are to be considered as included in the informative contents of the present patent application.

Well drilling apparatus 2 according to the present invention allows for fast switching between the assembling configuration and the operating configuration, while also simplifying the structure of the apparatus, which is easy to assemble, and allowing the apparatus to be moved on drilling site "S". Movement occurs when well drilling apparatus 2 is in its operating configuration.

In a preferred, but non-limiting, embodiment of well drilling apparatus 2 according to the present invention, said first sub-base 211 is configured for coupling to an actuator device 3.

Said actuator device 3 is adapted to allow well drilling apparatus 2 to switch from the assembling configuration to the operating configuration, and vice versa.

Said actuator device 3 is preferably a hydraulic device which is directly connected to mast 23, allowing the latter to switch from a substantially horizontal position to a substantially vertical position, and vice versa.

Said actuator device 3 is removable from well drilling apparatus 2 when the latter is in the operating configuration.

Such an embodiment allows for easy assembling of actuator device 3, which can raise, with a single movement, both mast 23 and drill floor 22, thus setting well drilling apparatus 2 in the operating configuration. Besides, this technical solution allows reducing the total weight of well drilling apparatus 2, which will have to be moved between wells "W" on drilling site "S". In fact, actuator device 3 is removed from well drilling apparatus 2 after mast 23 has been moved, thus simplifying the structure of well drilling apparatus 2 and reducing the load that needs to be transported while moving well drilling apparatus 2.

In an even more preferable embodiment of well drilling apparatus 2 according to the present invention, said actuator device 3 comprises: two base structures 32 arranged parallel and equally spaced apart, lying on the ground; and two raising cylinders 31 of the hydraulic type, one for each base structure 32.

Preferably, each hydraulic cylinder 31 is connectable at one end to said base structure 32 and at the opposite end to a lower intermediate section 232 of mast 23.

In general, said hydraulic cylinders 31 are adapted to exert a force on mast 23, in particular a thrust force for switching from a substantially horizontal position to a substantially vertical position, and a pulling or retaining force for switching from a substantially vertical position to a substantially horizontal position.

In general, the thrust exerted on mast 23 is such as to allow the switching from a substantially horizontal position to a substantially vertical position with a single movement. Such movement allows well drilling apparatus 2 to switch from the assembling configuration to the operating configuration.

Mast 23, pushed by said actuator device 3, makes a continuous movement, with no interruptions, and without taking ay intermediate positions between the substantially horizontal position and the substantially vertical position.

Because it occurs in a single step, the movement of mast 23 and of drill floor 22 connected thereto allows for increased safety while assembling well drilling apparatus 2, since there are no intermediate configurations and no other auxiliary devices need to be installed.

The present solution also allows eliminating the need for any additional devices for properly positioning both mast 23 and drill floor 22, thus making the assembly operations simpler and reducing the installation costs and times. Moreover, since the operations for assembling the various parts are carried out at ground level, the use of hoisting devices, e.g. cranes, is reduced, particularly for lifting heavy and massive loads.

The sequence of FIGS. 12A, 13 and 14 allows understanding the continuous and single movement that is made by mast 23 thanks to actuator device 3, in accordance with the present invention. In particular, actuator device 3 is able to simultaneously raise mast 23 and drill floor 22 by means of a thrust applied directly to mast 23.

The present technical solution allows implementing a single actuator device 3 that allows raising the entire well drilling apparatus 2, in particular both said mast 23 and drill floor 22.

In the preferred embodiment, said actuator device 3 acts upon, i.e. pushes against, a single point of mast 23, in particular in the lower intermediate section. The point of application of the force of actuator device 3 does not change while switching from the substantially horizontal position to the substantially vertical position, and vice versa.

Figure 4:
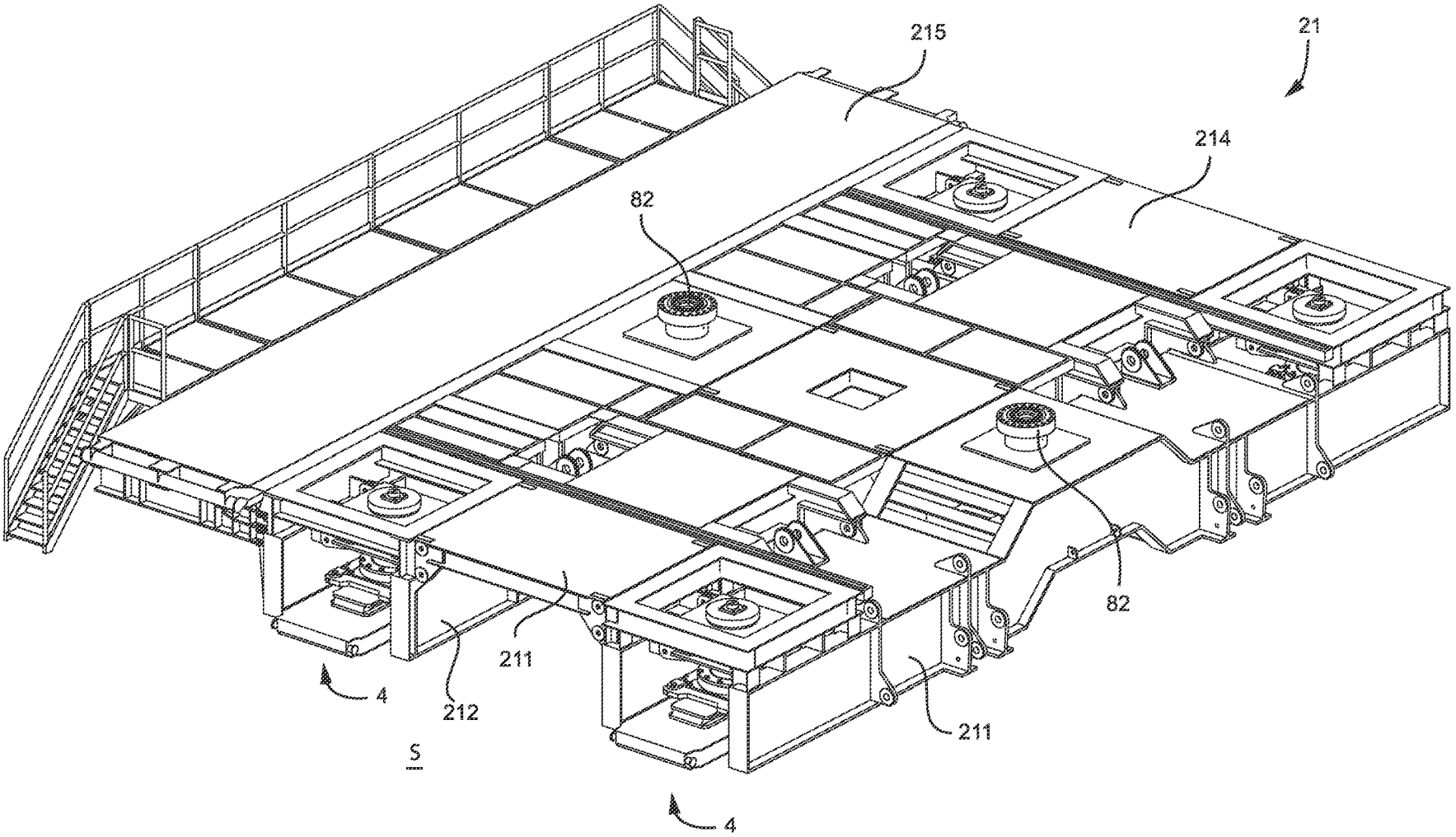
FIG. 4 shows an assembled substructure, also including the assembled connection and cantilevered structures for supporting the devices, systems and/or plants comprised in the well drilling apparatus according to the present invention.

In general, in well drilling apparatus 2 according to the present invention, said substructure 21 comprises cantilevered structures 215, connected to one or more of said sub-bases (211, 212). Preferably, said substructure 21 comprises connection structures 214 connected to both sub-bases (211, 212), and in particular positioned between said sub-bases (211, 212). FIG. 4 shows, for example, one possible arrangement of connection structures 214 and of cantilevered structures 215.

Said cantilevered structures 215 and said sub-bases (211, 212) and/or said connection structures 214 are adapted to support, whether directly or indirectly, all the devices, systems and/or plants comprised in well drilling apparatus 2.

In particular, such structures are adapted to create a flat structure whereon the various components of well drilling apparatus 2 according to the present invention can be connected and supported, in particular whereon large and/or heavy devices, systems and/or plants can be positioned, directly on substructure 21, without requiring the use of any hoisting devices, such as large cranes. For example, on the structure thus defined of substructure 21 it is possible to position blow-out preventer or BOP 8, BOP control system 81 and mud processing system 53, as well as other devices, as shown by way of example in FIG. 5.

The devices associated with substructure 21 according to the present invention will be moved integrally with the movements of the same substructure 21 in which walking devices 4 are comprised.

Furthermore, also the above-mentioned draw-works 58 is positioned on substructure 21, in particular draw-works 58 of well drilling apparatus 2 in the rear part of substructure 21, in particular in the part behind said connection portion 222 of drill floor 22, more in particular substantially above the second sub-base 212 and/or a connection structure 214 and/or cantilevered structures 215 connected to said second sub-base 212.

In well drilling apparatus 2 according to the present invention, draw-works 58 remains in a low position on substructure 21.

This solution also makes it possible to simplify the structure of drill floor 22, which is not required to support also the weight of draw-works 58. This makes drill floor 22 easier to move, while simplifying the structure that must support it.

Moreover, the position of draw-works 58 on the second sub-base 212 allows for easier maintenance of draw-works 58 and easier electric connections to the motors that drive the draw-works.

In one possible exemplary, but non-limiting, embodiment of well drilling apparatus 2 according to the present invention, at least one support element 217 is comprised. Said support element 217 is connected at one end to said first sub-base 211, while at the opposite end said at least one support element 217 is connected to said first portion 22*a* of drill floor 22.

Said at least one support element 217 allows increasing the load that can be withstood by the first portion 22*a* of drill floor 22, which, as previously specified, is hinged to mast 23, and in particular to a bottom section 231 of mast 23.

Said at least one support element 217 is hinged between said first portion 22*a* of drill floor 22 and the first sub-base 211 of substructure 21. This embodiment allows said at least one support element 217 to be assembled horizontally and placed into a substantially vertical position by moving well drilling apparatus 2, as it switches from the assembling configuration to the operating configuration, e.g. while moving mast 23 from a substantially horizontal position to a substantially vertical position, and vice versa.

Preferably, said first portion 22*a* of the drill floor, adapted to be hinged to mast 23, comprises, in addition to the structural part, the guides for moving BOP devices 8, the mouse hole, rotary table 56, auxiliary draw-works, the iron roughneck, etc.

Such devices are assembled on the first portion 22*a* of drill floor 22, which is arranged horizontally, thereby facilitating the operations necessary for positioning and assembling the various devices, systems and/or plants.

In general, in one possible exemplary, but non-limiting, embodiment of well drilling apparatus 2 according to the present invention, said first sub-base 211 and said second sub-base 212 comprise each a connection element 82, known in the industry as test stump, with which a blow-out preventer or BOP 8 is associable. One possible conformation of connection element 82 is visible in FIGS. 3-4. Said connection element 82 performs also the function of testing the BOP before using it over a well "W".

Such an embodiment allows maximizing the functionalities of substructure 21, since it can also support BOPs 8, moving them between the various wells "W" and appropriately positioning them over a well "W" during the drilling phases, as known to the person skilled in the art.

This solution allows arranging a first BOP 8 over one well "W" and, in parallel, in particular simultaneously, testing a second BOP 8, which can then be used as soon as necessary. In a preferred, but non-limiting, embodiment of well drilling apparatus 2 according to the present invention, said first sub-base 212 and said second sub-base 212 are configured, in particular shaped, for housing more than one pair of hydraulic walking devices 4.

In general, each pair of walking devices 4 is adapted to move well drilling apparatus 2 along at least one predefined direction, more preferably in both senses along said predefined direction. In the present embodiment, the plurality of pairs of walking devices 4, for each sub-base (211, 212), allow moving well drilling apparatus 2 along at least two predefined directions. The present embodiment, since more than one pair of walking devices 4 can be associated with each sub-base (211, 212), allows designing well drilling apparatus 2 for making the desired movements and/or in such a way that its functionalities can be changed as required, e.g. depending on the layout of wells "W" on drilling site "S".

Preferably, each pair of walking devices 4 is arranged at the ends of each sub-base (211, 212). Preferably, the conformation of each end of each sub-base (211, 212) is so designed that it can be associated with one or more walking devices 4.

In general, each sub-base allows changing the configuration and/or the position of associated walking devices 4.

Such an embodiment allows modifying one or more walking devices 4 and/or changing the orientation or configuration thereof.

In particular, in the preferred, but non-limiting, embodiment of the sub-bases (211, 212), they are designed for housing the walking devices in a housing formed under the sub-bases themselves, and also for allowing said walking devices 4 to be associated, in particular rigidly secured, outside the sub-base outline, e.g. connected to a side of the sub-bases.

The change of position of walking devices 4 relative to the respective sub-bases (211, 212) can be effected at any time as necessary, e.g. according to space or mobility requirements of well drilling apparatus 2 according to the present invention.

Therefore, walking device 4 can take at least two different assembly configurations relative to sub-bases (211, 212) of substructure 21.

By changing the configuration of walking devices 4 it is possible to vary their arrangement, e.g. the direction along which they can move. The possibility of changing the configuration of walking devices 4 is particularly advantageous in that it ensures better flexibility of well drilling apparatus 2, which can be adapted to the different possible configurations of the wells to be drilled. Therefore, according to the distance between wells "W", it will be possible to choose the best configuration of walking devices 4.

This embodiment provides a ductile well drilling apparatus 2, which can be adapted to the requirements of drilling site "S" whereon it will have to operate.

In general, in one possible exemplary, but non-limiting, embodiment of well drilling apparatus 2, to ramp 262 of a catwalk 26, connected to the first portion 22*a* of drill floor 22, a support structure 264 is fixed. A the opposite end, said support structure 264 is fixed to the first sub-base 211.

This embodiment allows ramp 262 of catwalk 26 to be firmly fixed to the first portion 22*a* of drill floor 22. In this way it is also possible to keep said ramp 262 connected to well drilling apparatus 2 while moving well drilling apparatus 2 between the various wells "W" of drilling site "S". Ramp 262 separated from catwalk 26 will move integrally with well drilling apparatus 2, while the remaining part of catwalk 26 will be moved independently.

In one possible exemplary, but non limiting, embodiment, said catwalk 26 comprises in turn a walking device 266. Said walking device 266 can move said catwalk 26 along at least one specific direction. Said walking device 266 comprised in catwalk 26 can be implemented by exploiting the same construction technology suitable for making walking devices 4 comprised in well drilling apparatus 2 according to the present invention, appropriately sized for moving a device that is smaller and lighter than a well drilling apparatus 2 according to the present invention.

Mobile well drilling apparatus 2 according to the present invention is particularly suitable for being assembled in a simple and rapid manner in order to be quickly put into the operating configuration.

The method of assembling a well drilling apparatus 2 according to the present invention comprises the following steps:

- arranging a substructure 21 comprising a first sub-base 211 and a second sub-base 212 arranged spaced apart and parallel to each other;
- positioning on said substructure 21 a first plurality of devices, systems and/or plants comprised in well drilling apparatus 2, including a draw-works 58;
- positioning an actuator device 3, associating it with said first sub-base 211;
- assembling a first portion 22*a* of a drill floor 22 at ground level;
- assembling a bottom section 231 of a mast 23 by connecting hinging points 23*a* comprised in mast 23 to said first sub-base 211; and connecting said first portion 22*a* of drill floor 22 to bottom section 231 of mast 23;
- assembling a second portion 22*b* of drill floor 22, rigidly fastening it to said bottom section 231 of mast 23;
- completing the assembly of mast 23;
- connecting actuator device 3 to said lower intermediate section 232 of mast 23;
- raising assembled mast 23, switching from a substantially horizontal mast position to a substantially vertical mast position, in which position fixing points 23*b* of mast 23 are constrained to said second sub-base 212;
- positioning on said substructure 21 and/or on said drill floor 22 a second plurality of devices, systems and/or plants comprised in well drilling apparatus 2.

The above-described method represents one possible embodiment of the steps to be carried out in order to assemble the well drilling apparatus according to the present invention.

In the preferred embodiment, the step of arranging a substructure 21 comprises the following sub-steps:

- positioning a first sub-base 211 on drilling site "S";
- positioning a second sub-base 212 parallel to and at a predefined distance from said first sub-base 211;
- positioning connection structures 214 between said first sub-base 211 and said second sub-base 212 for interconnecting them;
- positioning cantilevered structures 215 protruding from at least one of said first sub-base 211 and said second sub-base 212.

The step of arranging a substructure 21 allows defining the space whereon the remaining parts of well drilling apparatus 2 will be positioned.

Each sub-base (211, 212) comprises at least one pair of hydraulic walking devices 4.

Such walking devices 4 will be able to move the entire well drilling apparatus 2 according to the present invention.

In a preferred embodiment, a sub-step is carried out wherein, prior to the sub-step of positioning a first sub-base 211 and/or the sub-step of positioning a second sub-base 212, walking devices 4 are associated with the respective sub-base (211, 212). During this sub-step, it is possible to choose the configuration of the walking devices 4, e.g. housed in suitable housings formed in the same sub-bases, or rigidly fastened outside the outline of the sub-bases, as previously specified.

Figure 3:
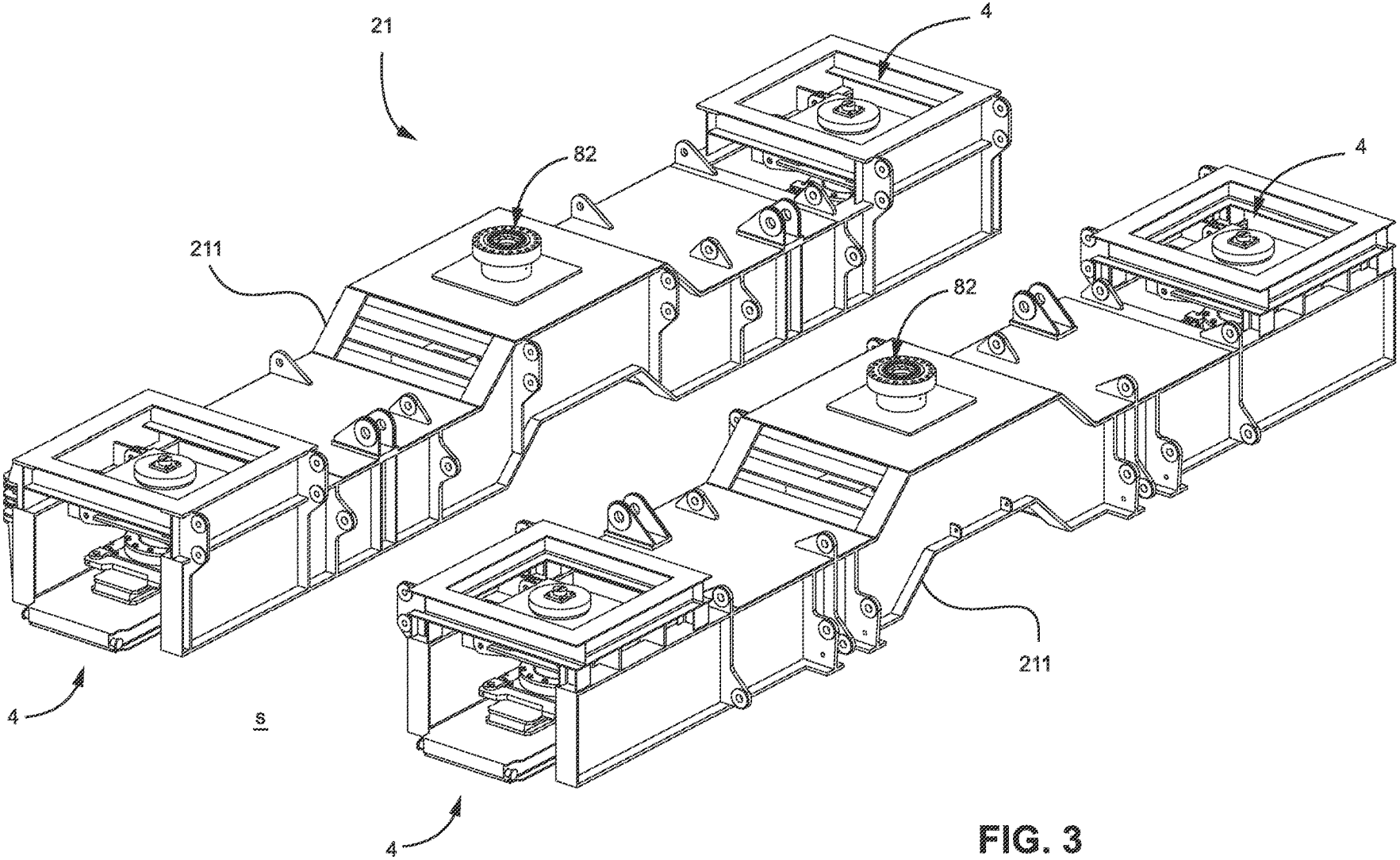
FIG. 3 shows an axonometric view of two sub-bases comprised in a substructure, appropriately arranged.

By way of example, FIG. 3 shows well drilling apparatus 2 after the sub-step of positioning a second sub-base 212. In fact, in this figure one can see the first sub-base 211 and the second sub-base 212 arranged side by side, parallel to and at a predefined distance from each other.

In the same figure, one can identify walking devices 4 housed in the respective housings formed under the sub-bases.

FIG. 4 shows well drilling apparatus 2 at the end of the step of arranging a substructure 21, more particularly at the end of the sub-step of positioning cantilevered structures 215.

Subsequently, the method of assembling continues with the step of positioning on said substructure 21 a first plurality of devices, systems and/or plants comprised in well drilling apparatus 2. Said devices, systems and/or plants include draw-works 58.

Figure 5:
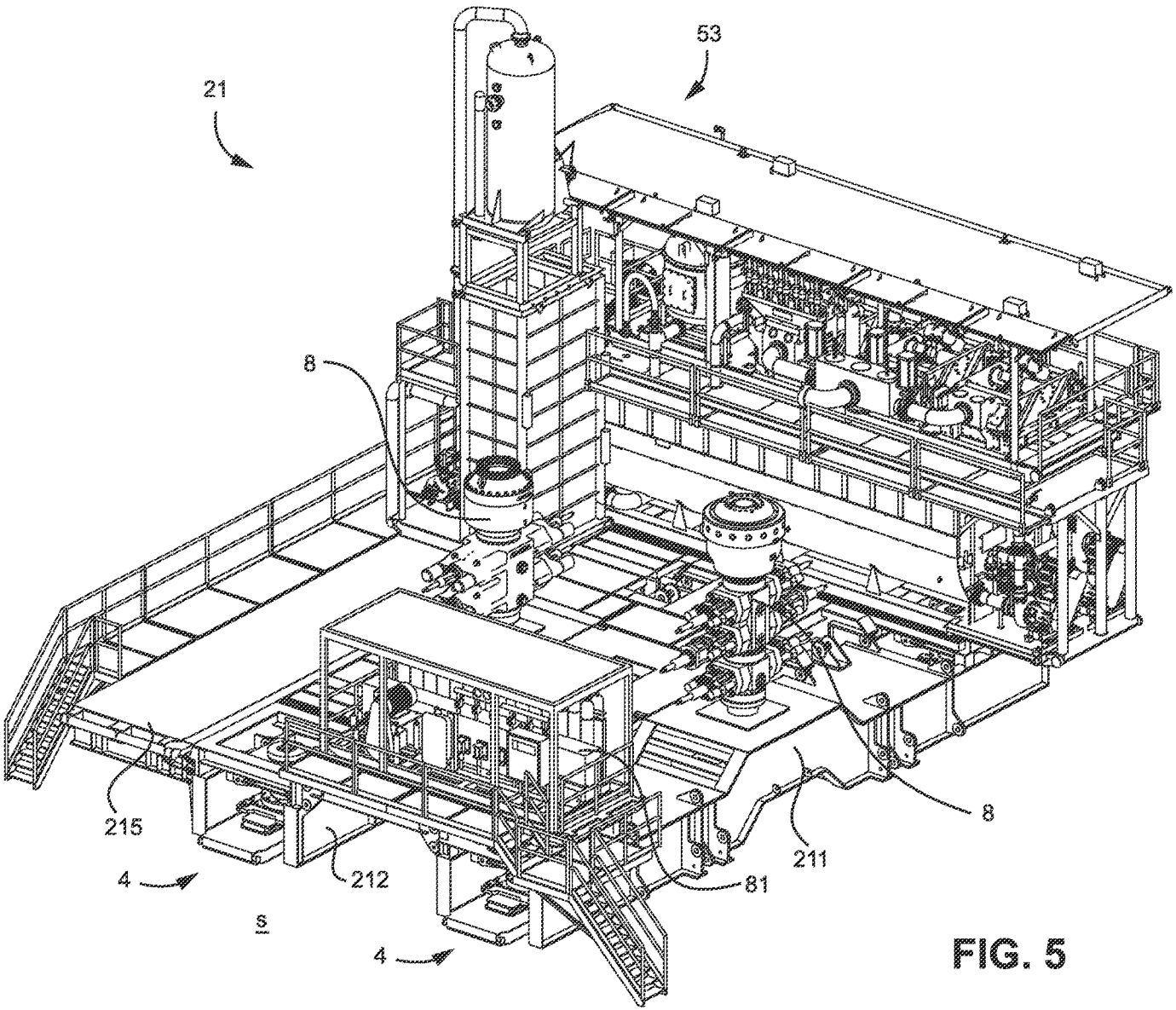
FIG. 5 shows the substructure with which a plurality of devices, systems and/or plants of the well drilling apparatus according to the present invention have been associated.
Figure 6:
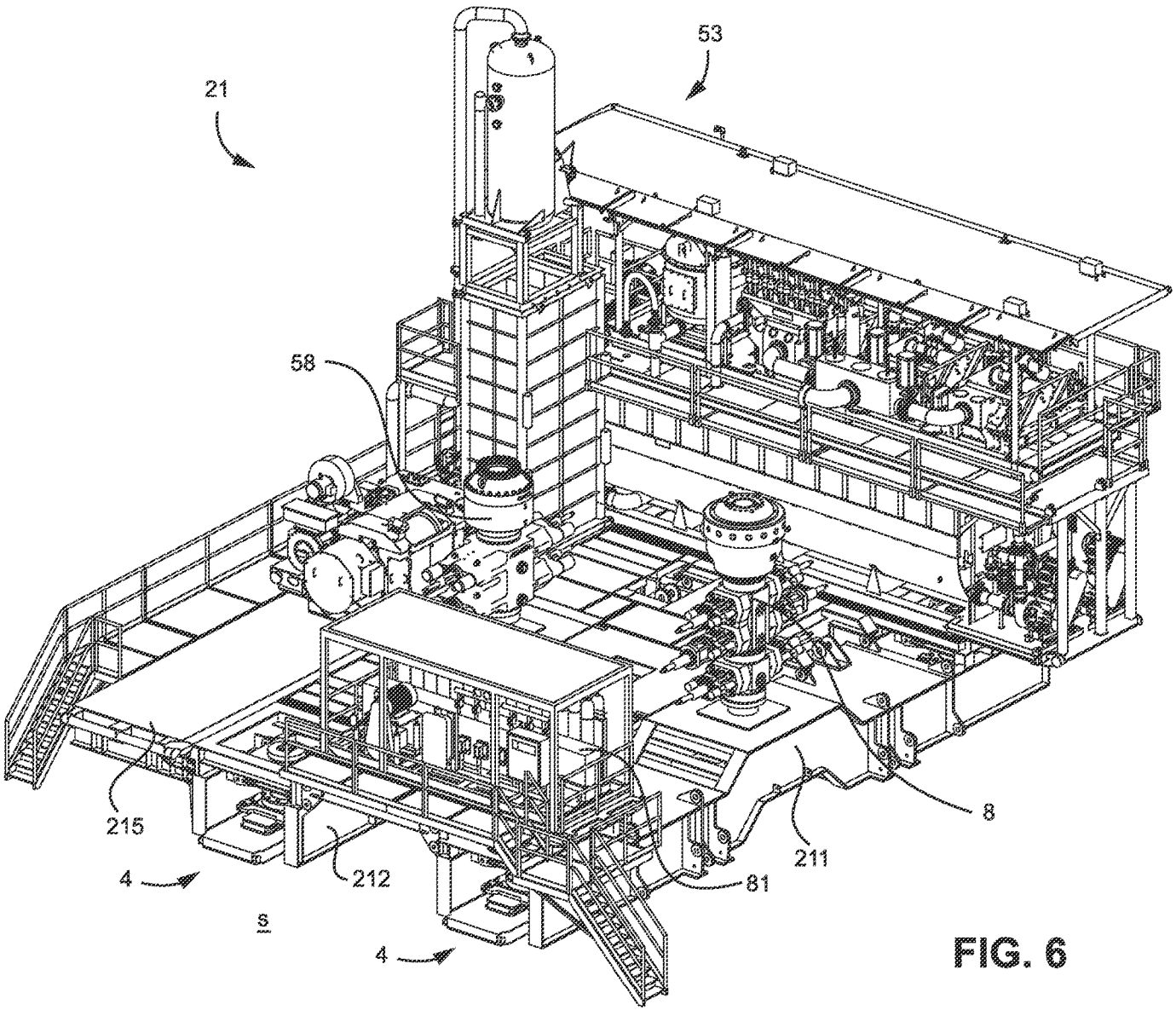
FIG. 6 shows the arrangement of a draw-works of the well drilling apparatus, wherein the draw-works has been permanently installed on the substructure.

In this step, for example, control system 81 for the blow-out preventer or BOP 8 and mud processing system 53 are positioned. Neither control system 81 nor mud processing system 53 will be described any further herein, since their operation is known to the person skilled in the art and the individual elements comprised therein can be inferred by the person skilled in the art in the light of the annexed drawings. FIG. 5, for example, shows well drilling apparatus 2 after the step of positioning a first plurality of devices, systems and/or plants on said substructure 21. Furthermore, FIG. 6 shows the positioning of draw-works 58 on substructure 21, in particular on a cantilevered element 215 connected to the second sub-base 212.

The present step of the method allows positioning on substructure 21 some of the devices, systems and/or plants that are essential for the operation of well drilling apparatus 2 on substructure 21, thus simplifying the assembly operations, since the various parts can be assembled at ground level without requiring the intervention of hoisting systems, such as dedicated cranes. This is particular advantageous for draw-works 58.

The distance between sub-bases (211, 212) is such as to create a surface of substructure 21 that is capable of housing and/or supporting all the essential elements of the drilling apparatus 2 according to the present invention, allowing it to move between the various wells "W" on a drilling site "S".

The method of assembling includes a step of positioning an actuator device 3, associating it with said first sub-base 211. This step is preferably carried out after or simultaneously with the step of positioning on said substructure 21 a first plurality of devices, systems and/or plants.

In the step of positioning an actuator device 3, the same actuator device 3 is positioned at ground level. In the preferred embodiment, said actuator device 3 comprises two base structures 32, opposite and parallel to each other, and two cylinders 31. Such base structures 32 are associated with the first sub-base 211 and are laid on the ground at a predefined distance from each other.

One cylinder 31 is associated with each base structure 32. Said cylinder 31 is fixed at one end to said base structure 32 and at the other end to a portion of the mast 23.

The method also provides for the execution of a step of assembling a first portion 22*a* of a drill floor 22 at ground level. Such step is preferably carried out after or simultaneously with the step of positioning an actuator device 3.

During the step of assembling a first portion 22*a* of a drill floor 22, the following sub-steps are carried out:

positioning rotary table 56, and positioning the portion of the first structure 22*a* that comprises connection portion 222, to which ramp 262 of a catwalk 26 can then be connected.

The step of assembling a first portion 22*a* of a drill floor 22 preferably includes a further sub-step of positioning support elements 217 adapted to support said first portion 22*a* of drill floor 22.

Figure 7:
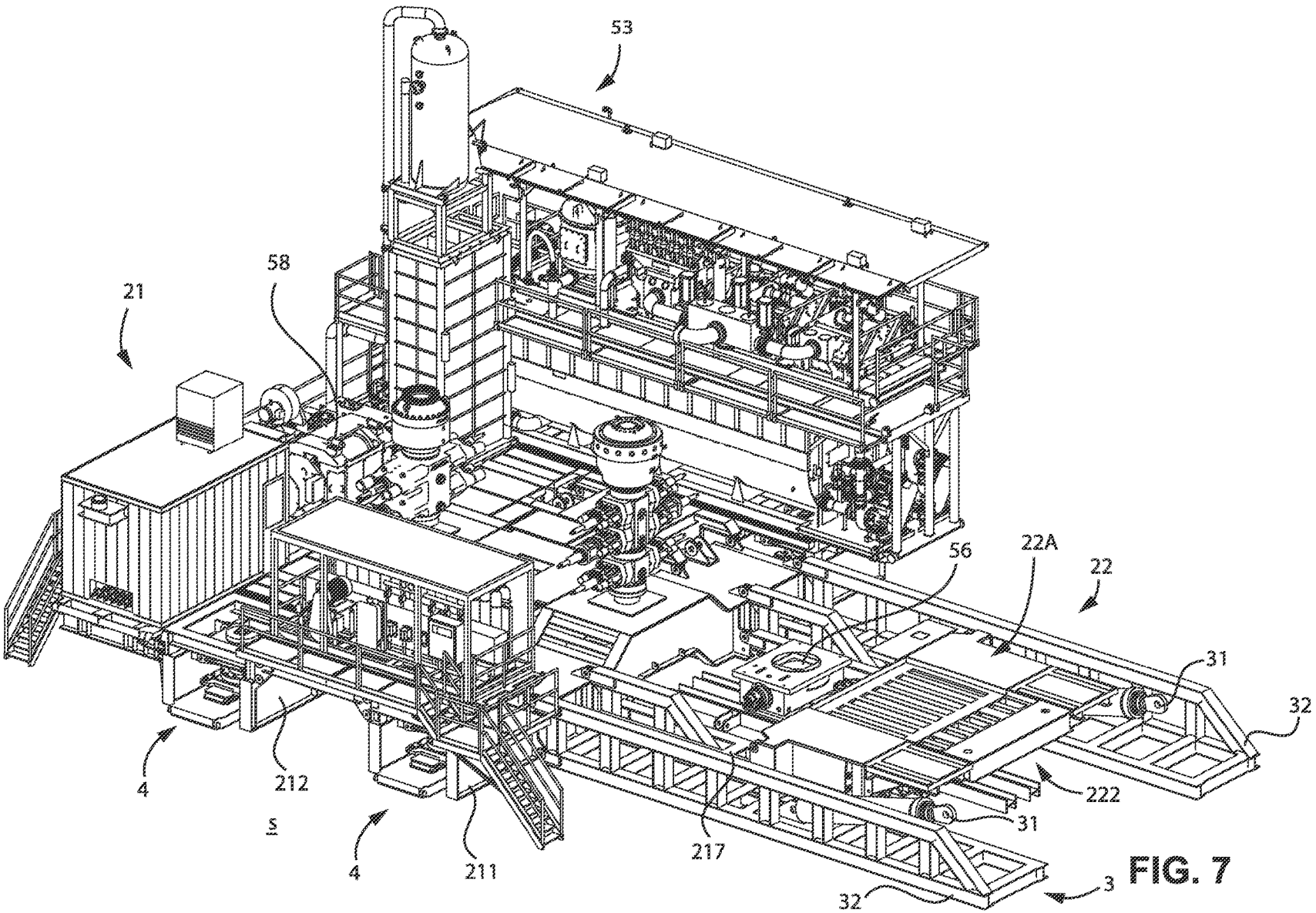
FIG. 7 shows the installation of the actuator device for raising the mast and the drill floor; the latter, in particular the first portion of the drill floor, is partially assembled at ground level.

By way of example, FIG. 7 shows well drilling apparatus 2 after the step of assembling a first portion 22*a* of a drill floor 22. The steps of assembling the above-mentioned parts will not be described any further herein, since the person skilled in the art can determine, in the light of the drawings, sufficient construction details to be able to implement the steps of the method according to the invention.

Subsequently, the method of assembling includes the step of assembling a bottom section 231 of a mast 23. FIG. 8A shows the bottom section 231 of mast 23 assembled in well drilling apparatus 2 according to the present invention.

In this step, hinging points 23*a* comprised in mast 23 are connected to said first sub-base 211.

Also, in this step said first portion 22*a* of drill floor 22 is connected to the bottom section 231 of mast 23. In the light of the present step and of the previously described step, it is apparent that mast 23 and drill floor 22 are assembled in such a way that the connection portion 222 will face towards a sub-base (211, 212), in particular said first sub-base 211, and that the same parts will be assembled along a direction substantially perpendicular to the longitudinal axis of the first sub-base 211. It is therefore evident that well drilling apparatus 2 will be assembled in a manner such that connection portion 222 of drill floor 22 will face towards the first sub-base 211, while back 23*c* of mast 23 will face towards the second sub-base 212.

It is apparent from the present step that mast 23 is hinged to substructure 21 and that at least a portion of drill floor 22 is in turn hinged to mast 23. Such a configuration will allow raising mast 23 and the drill floor with a single, continuous movement.

In a preferred embodiment, said step of assembling a bottom section 231 of a mast 23 comprises the following sub-steps:

assembling a left-hand bottom section 231*a;* assembling a right-hand bottom section 231*b;* assembling a connection structure 231*c*, adapted to rigidly connect said right-hand bottom section 231*b* and said left-hand bottom section 231*a* to each other. This sequence of steps allows securing the portions of bottom section 231 to each other, connecting them in a rigid manner.

FIGS. 8B and 8C show one possible embodiment concerning the positioning of connection structure 231*c* for connecting right-hand bottom section 231*b* and left-hand bottom section 231*a* of mast 23 and the fixing of connection structure 231 to the bottom sections of mast 23.

In FIG. 8A one can also see that devices of well drilling apparatus 2, e.g. a pair of power tongs and various service draw-works, have been assembled on the first portion 22*a* of drill floor 22.

In general, the conformation of bottom section 231 of mast 23 allows building a more compact well drilling apparatus 2, because it is possible to position parts and components of well drilling apparatus 2 between the two portions (231*a*, 231*b*) of bottom section 231, thus exploiting the available room in a more effective manner and consequently reducing the maximum planar extension of well drilling apparatus 2.

The method of assembling preferably includes, after the step of assembling a bottom section 231 of mast 23, a step of assembling a second portion 22*b* of drill floor 22. During this step, said second portion 22*b* of drill floor 22 is rigidly fastened to said bottom section 231 of mast 23. The second portion 22*b* of drill floor 22 is preferably fastened to that face of mast 23 which corresponds to back 23*c* of mast 23 itself. Said second portion 22*b* of drill floor 22 does not need to be kept horizontal, since it is less heavy than the remaining parts of drill floor 22.

FIG. 9 shows one possible embodiment concerning the assembling of the second portion 22*b* of drill floor 22 to mast 23.

The method of assembling includes, after the step of assembling a second portion 22*b* of drill floor 22, a step of completing the assembly of mast 23. In the preferred, but non-limiting, embodiment, said mast 23 comprises a lower intermediate section 232, an upper intermediate section 233 and a top section 234. Said sections are appropriately connected together and rigidly fixed for constituting mast 23 of well drilling apparatus 2 according to the present invention.

In a preferred embodiment, the assembly of said lower intermediate section 232 comprises the following sub-steps:

assembling a left-hand lower intermediate section 232*a;* assembling a right-hand lower intermediate section 232*b;* assembling a connection structure, adapted to rigidly connect said right-hand lower intermediate section 232*b* and said left-hand lower intermediate section 232*a* to each other. This sequence of steps allows securing the portions of lower intermediate section 232 to each other. Said lower intermediate section 232 is appropriately constrained, in particular rigidly fixed, to bottom section 231. FIG. 10 shows the conclusion of the assembly of lower intermediate section 232. In this figure one can see stands 6 used for supporting the stump of mast 23 assembled so far.

The conformation of lower intermediate section 232 of mast 23 allows creating a more compact well drilling apparatus, as previously specified.

The upper intermediate section is then assembled. The conclusion of the assembly process is shown by way of example in FIG. 11.

upper intermediate section 233, adapted to be constrained, in particular rigidly fixed, to said lower intermediate section 232, is adapted to internally house, in particular during the operations for moving and assembling well drilling apparatus 2, said top drive 51. By arranging top drive 51 in the upper intermediate section, it is possible to prevent an excessive distribution of the load in the peripheries of mast 23, thus making the latter easier to raise for switching from the horizontal position to the vertical position.

In one possible embodiment, said racking board 71 is appropriately constrained, in particular hinged, to said upper intermediate section 233. In one possible embodiment, said racking board 71 is already integral with a portion of mast 23, e.g. with said upper intermediate section 233 or said top section 234, so that it will be moved solidly with said mast portion prior to assembling the apparatus.

As an alternative, said racking board 71 is assembled to mast 23, and in particular to upper intermediate section 233, or to top section 234, in a horizontal configuration, thus facilitating the transfer and assembly operations.

In general, said racking board 71 is hinged in such a way as to automatically take a horizontal configuration when the mast is pushed into the substantially vertical position. FIG. 12B shows how said racking board 71 is arranged to rotate as mast 23 is raised.

Said racking board 71 is preferably positioned at a height relative to drill floor 22 that allows it to appropriately house pipe strings consisting of three drill pipes arranged vertically, e.g. as shown in FIG. 1.

The method of assembling according to the present invention preferably includes a sub-step in which racking board 71 is released, so that it can rotate about an axis located at a section of mast 23, e.g. upper intermediate section 233 or top section 234. In this manner, when mast 23 is raised said racking board 71 will be able to automatically arrange itself in the working position, without requiring any further intervention by the operators.

To said upper intermediate section 233, said top section 234 is then constrained, in particular rigidly fixed, thus completing mast 23. Said top section 234 also includes the blocks and the pulleys for moving top drive 51, in particular the travelling block with the drilling line, the latter remaining mounted on the pulleys, thus speeding up the installation operations. FIG. 12A shows mast 23 completely assembled in all of its sections.

The operations for positioning and assembling the various sections of mast 23 are preferably carried out with the aid of stands 6. Such stands 6 are, for example, shown in FIGS. 10-12A and 13.

On the side corresponding to back 23*c* of mast 23 there is a guide 52 along which said top drive 51 and/or the travelling block can slide during the various operating phases of well drilling apparatus 2. FIG. 15 shows the position of said guide 52 along which said top drive 51 can slide.

In general, once the assembly of the different sections and parts of mast 23 is complete, the method provides for executing the step of connecting the actuator device 3 to said mast 23.

In the preferred embodiment, said actuator device 3, and in particular cylinders 31, are fixed to lower intermediate section 232 of the mast 23. More preferably, one cylinder 31 is fixed to left-hand lower intermediate section 232*a*, and a second cylinder 31 is fixed to the right-hand lower intermediate section 232*b*.

The points where actuator device 3 is connected to mast 23 are univocal and remain the same throughout the process of moving mast 23 between the substantially horizontal position and the substantially vertical position, and vice versa, allowing the switching from the assembling configuration to the operating configuration of well drilling apparatus 2.

The method of assembling according to the present invention includes, after the step of connecting actuator device 3 to mast 23, a step of raising assembled mast 23.

This step allows mast 23 to switch from a substantially horizontal position to a substantially vertical position.

FIG. 13 shows mast 23 at an intermediate point of its travel for switching from the horizontal position to the vertical position, and vice versa.

The movement of mast 23 under the action of actuator device 3 occurs in a single, continuous step, thus simplifying the assembly operations for arranging mast 23 in a vertical position.

Preferably, mast 23 is moved exclusively through the action exerted by actuator device 3, in particular a thrust action for switching from a horizontal position to a vertical position, and a pulling action, in particular a retaining action, for switching from the vertical position to the horizontal position.

The point where the force of actuator device 31 is applied remains the same during the movement of the mast.

FIG. 14 shows mast 23, and drill floor 22 connected thereto, in the vertical position after having being pushed by actuator device 3. In this figure one can see that cylinders 31 are in an extended configuration.

The same figure also shows support elements 217 adapted to support the first portion 22*a* of drill floor 22. Such support elements are in a substantially vertical position.

In this image one can see that the various portions (22*a*, 22*b*) of the drill floor, once mast 23 has been raised, form a substantially flat surface.

Following the execution of the step of raising mast 23, said fixing points 23*b* of mast 23 will be constrained to said second sub-base 212. In fact, once mast 23 has been raised and placed in a substantially vertical position, said fixing points 23*b* of mast 23 will be constrained to said second sub-base 212, while said hinging points 23*a* will be constrained to said first sub-base 211.

The method of assembling according to the present invention also includes, after the step of raising mast 23, a sub-step of removing actuator device 3. In this sub-step, actuator device 3, comprising said cylinders 31 and said base structures 32, is released from mast 23 and from substructure 21; in particular, one end of the cylinders is released from lower intermediate section 232 of mast 23, and base structure 32 is released from first sub-base 211 of substructure 21. With this technical solution it is possible to neatly separate actuator device 3 from well drilling apparatus 2, so that said actuator device 3 will not have to be transported even after it has completed its function, since it is possible to associate it with well drilling apparatus 2 only when necessary. FIGS. 15 and 16 show well drilling apparatus 2 after actuator device 3 has been removed.

This solution allows reducing the total weight of well drilling apparatus 2 when in use, in particular reducing the mass of well drilling apparatus 2 that needs to be moved on drilling site "S" between clustered wells "W".

The method of assembling also includes the step of positioning on said substructure 21 and/or on said drill floor 22 a second plurality of devices, systems and/or plants comprised in well drilling apparatus 2.

In this step, the remaining devices, systems and/or plants of well drilling apparatus 2 are added in order to ensure its proper operation. Such devices, systems and/or plants include: the hydraulic power unit; the drilling mud loading station; pipelines for transporting the drilling mud; driller cabin 24; collector circuits for mud circulation; reels for winding the drilling line; hoisting and walking systems for BOP 8, etc.

Well drilling apparatus 2 according to the present invention, e.g. assembled by using the above-mentioned method, can be associated with a catwalk 26 for lifting drill pipes from ground level to drill floor 22. The conformation of drill floor 22, and in particular of first portion 22*a*, comprises said connection portion 222, which allows associating a ramp 262 of the same catwalk 26. In the preferred embodiment, said connection portion 222 allows fixing said ramp 262. More preferably, well drilling apparatus 2 is configured in a manner such that drill floor 22 can support said ramp 262, e.g. with the aid of a support structure 264, while making it possible to separate ramp 262 from catwalk 26. This conformation of drill floor 22, which can support said ramp 262, allows well drilling apparatus 2 to move ramp 262 along with itself. This makes well drilling apparatus 2 easier to move, avoiding the need for separating and reconnecting the ramp of the catwalk every time well drilling apparatus 2 has to be moved.

Well drilling apparatus 2 according to the present invention is particularly suitable for being moved on drilling site "S" for reaching wells "W" located on said drilling site "S". The method of moving well drilling apparatus 2 according to the present invention comprises the following steps:

providing a direction of travel of well drilling apparatus 2;

appropriately activating a plurality of walking devices 4 associated with said sub-bases (211, 212).

The method of moving provides for keeping ramp 262 of a catwalk 26 associated with well drilling apparatus 2 while moving well drilling apparatus 2.

The present solution allows speeding up the apparatus transfer procedures and the installation of well drilling apparatus 2 after reaching well "W" of interest.

In this embodiment, catwalk 26 is moved independently of well drilling apparatus 2.

Said catwalk 26 comprises walking systems 266 capable of moving the catwalk and follow the movements of well drilling apparatus 2.

Figure 2A:
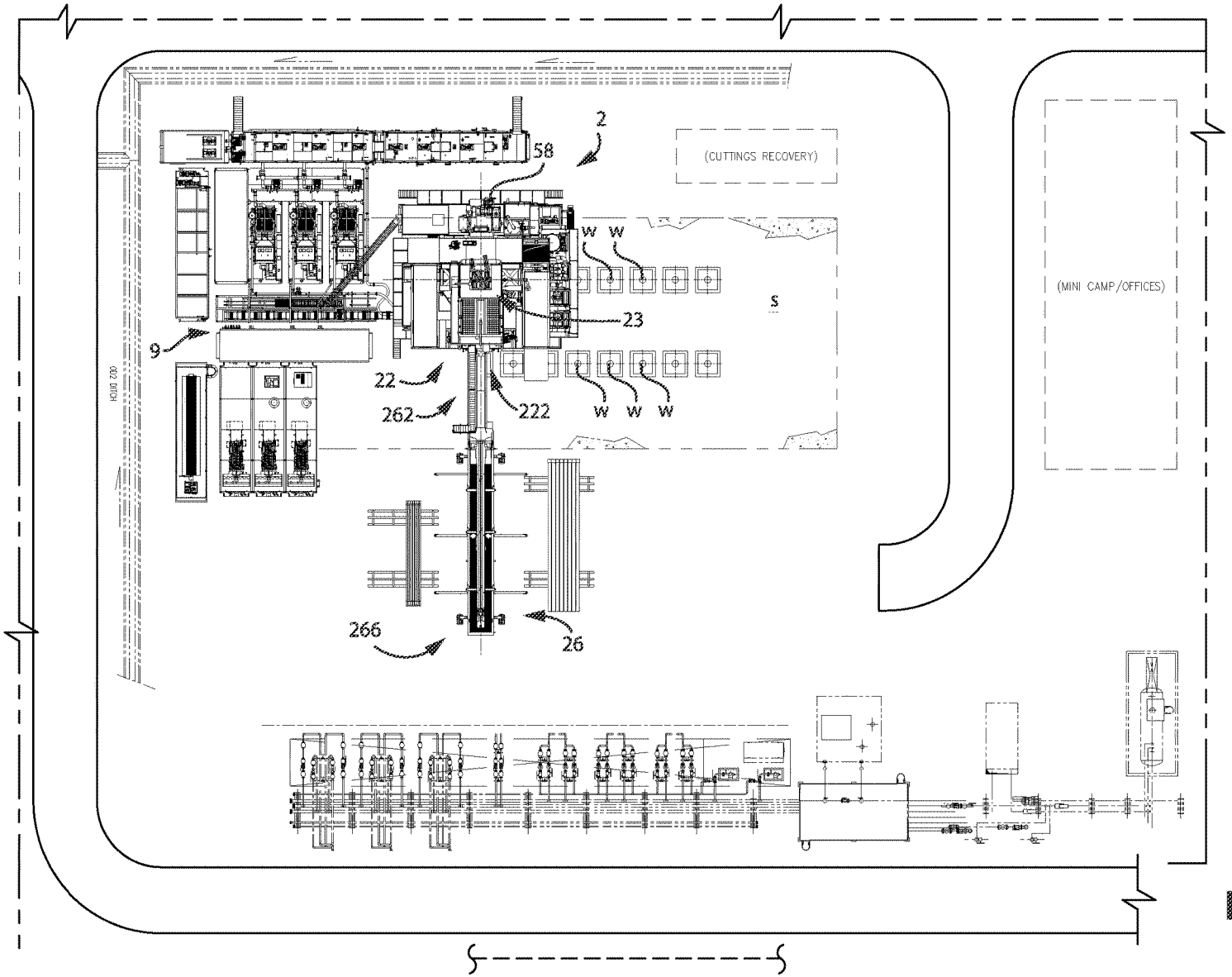
Figure 2B:
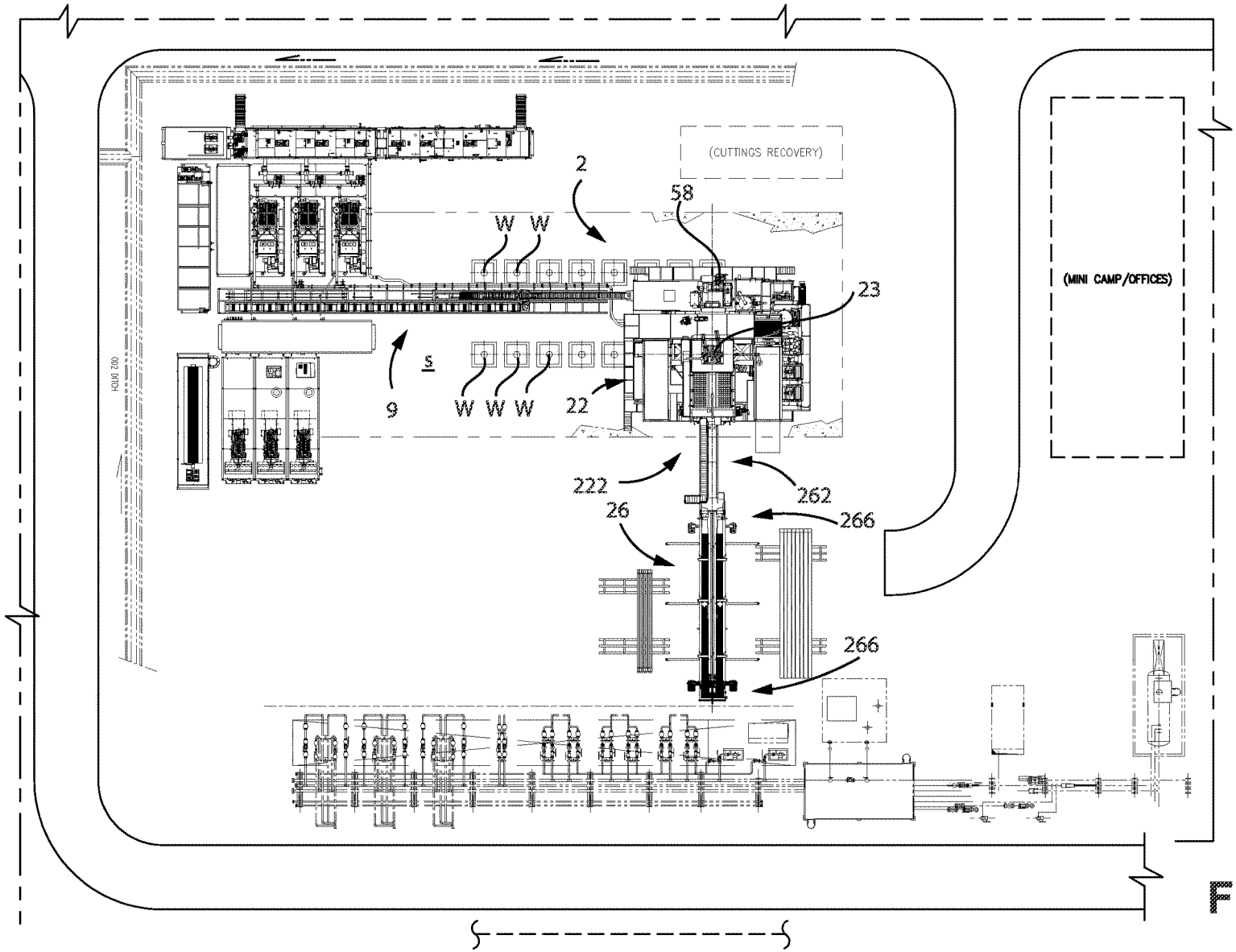
Figure 2C:
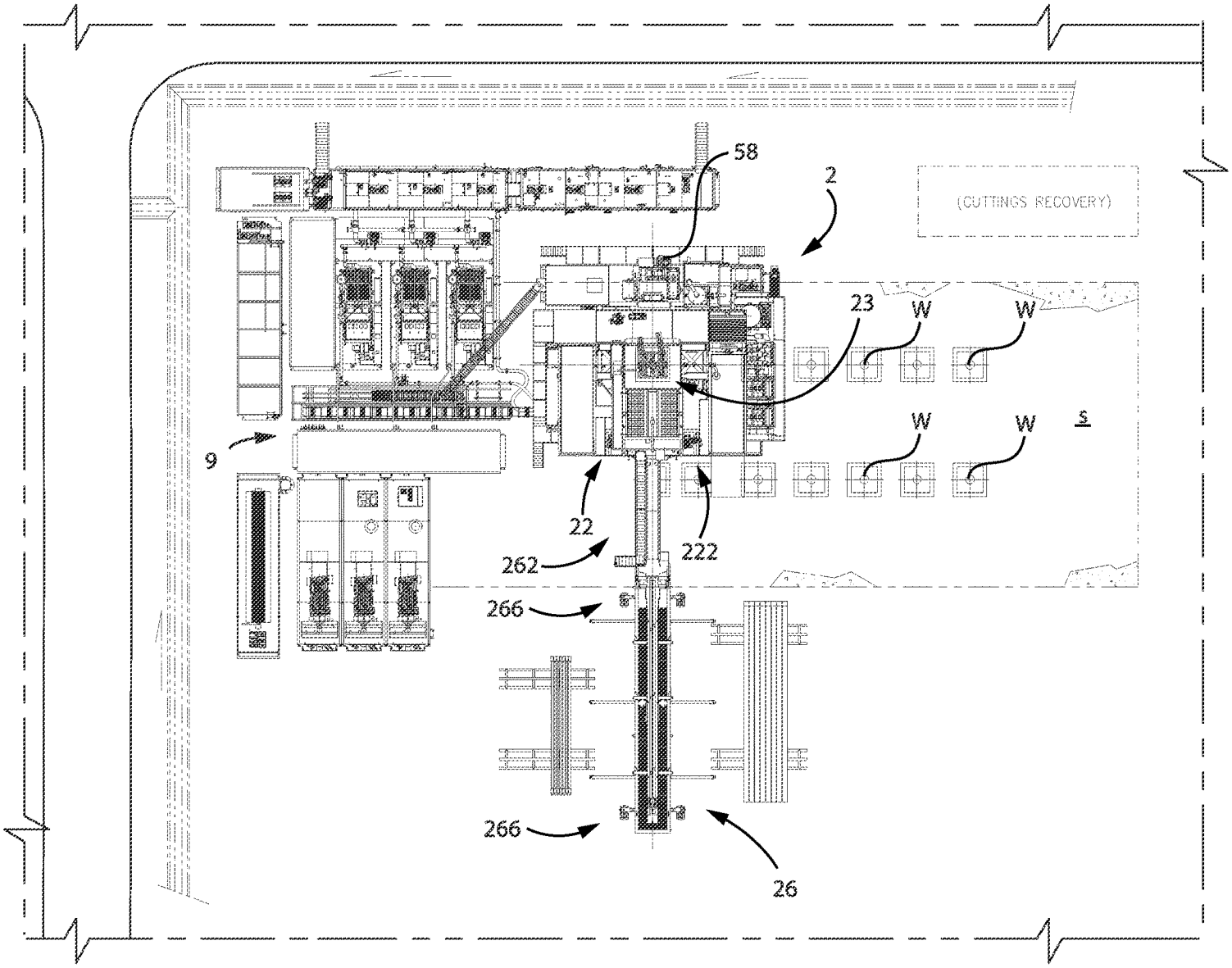
Figure 2D:
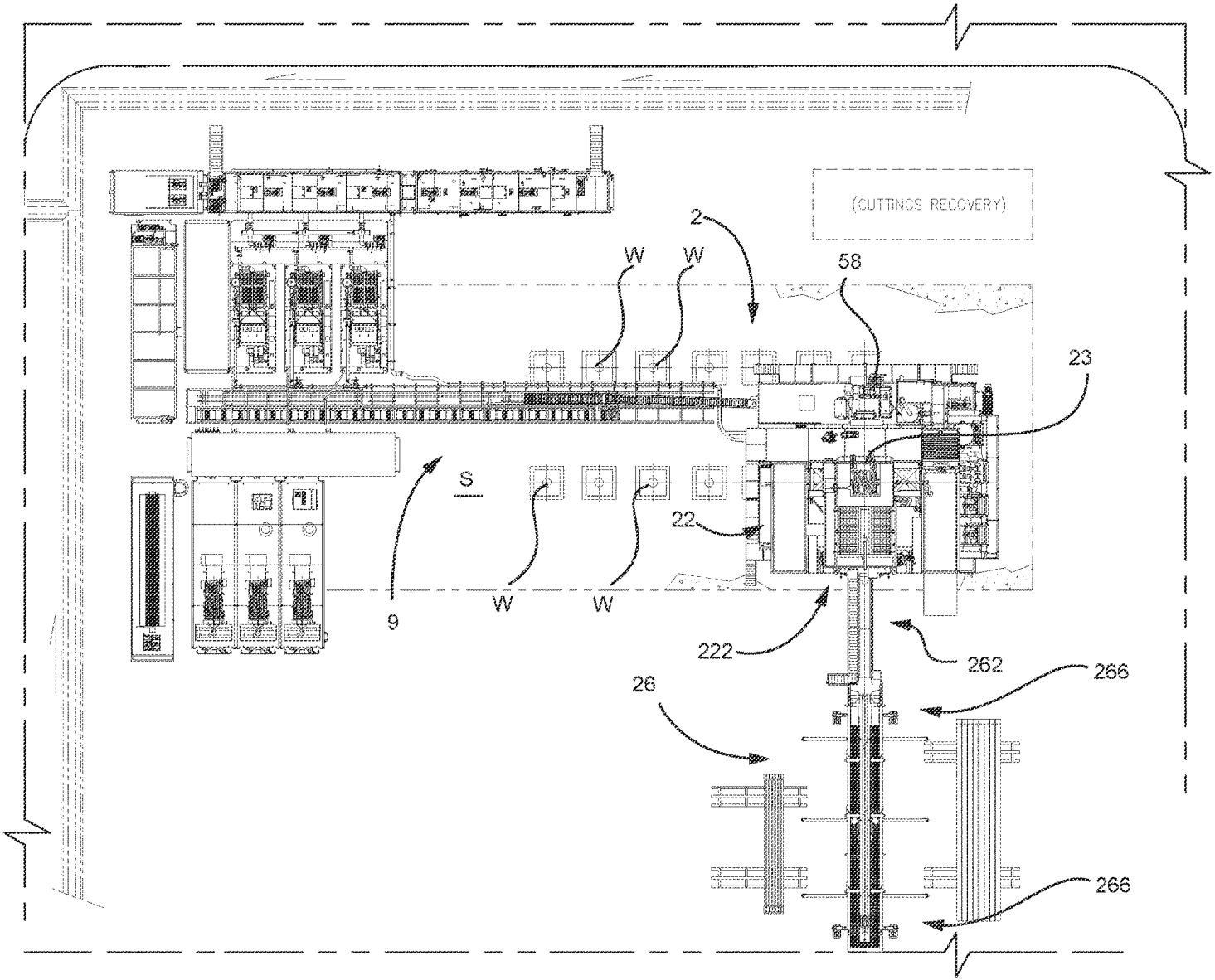

FIGS. 2A and 2B show well drilling apparatus 2 at two different wells "W".

As can be seen in this figure, also catwalk 26 has followed the movements of well drilling apparatus 2.

Figure 2E:
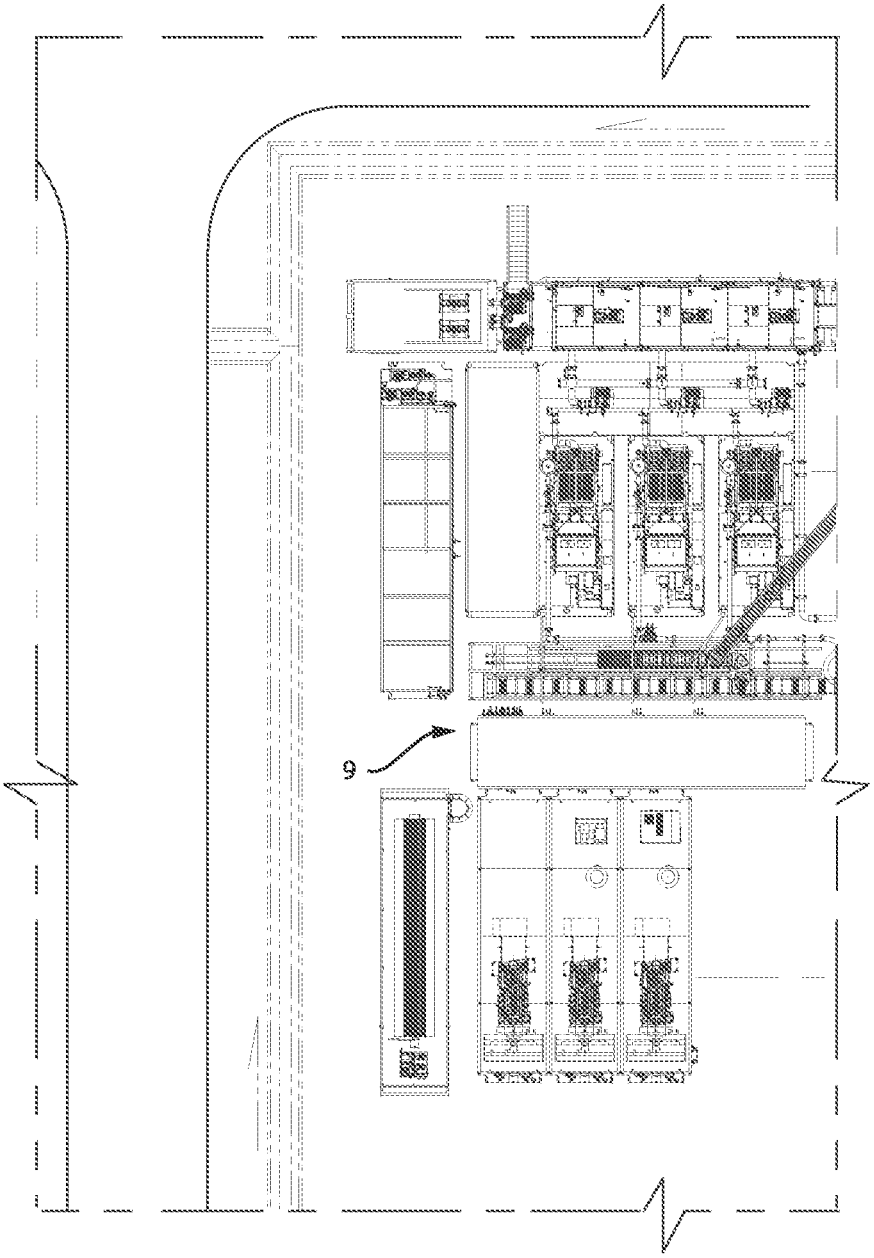

As can be seen, for example, in FIGS. 2A and 2B, well drilling apparatus 2 is associated with a cable and pipe management system 9, as shown in FIG. 2E. Said management system 9 is adapted to extend and contract, in order to allow cables and pipes to be connected to well drilling apparatus 2 as it is being moved between wells "W" comprised in drilling site "S". This system prevents cables and pipes from suffering compression or damages that might impair the electric and/or fluidic communication between well drilling apparatus 2 and the mud processing system located on drilling site "S", as shown in FIGS. 2A and 2B.

Said cable and pipe management system 9 comprises a plurality of slides capable of sliding along rails, so that it can extend and contract. The movements of said management system 9 can thus follow the movements of the well drilling apparatus 2.

This cable and pipe management system 9 provides the apparatus with a continuous connection to the electric systems comprised in drilling site "S".

Said cable and pipe management system 9 is useful to avoid having to disconnect and reconnect the systems when moving the well drilling apparatus, resulting in clear advantages. Moreover, such a solution allows reducing the risk of failures or malfunctions, since it will be no longer necessary to carry out frequent interventions for connecting or disconnecting the systems.

Well drilling apparatus 2 as a whole, since it comprises a plurality of walking devices 4 suitably arranged on the ground, can be moved, in particular translated, from a well "W" to another one comprised in drilling site "S". Such walking devices 4 may be either housed within the outline of sub-bases (211, 212) or fastened thereto in a cantilever fashion.

Well drilling apparatus 2 and the method of assembling and disassembling according to the present invention allow speeding up the installation of a well drilling apparatus 2, resulting in a considerable reduction of the installation times and costs.

The use of an actuator device 3, which pushes mast 23 in order to raise it and holds the same mast 23 during the descent, allows simplifying the steps of raising and lowering the apparatus, thus increasing safety during such operations. The possibility of completely removing actuator device 3 allows reducing the loads that need to be moved by walking devices 4 for transferring well drilling apparatus 2 from a well "W" to another well comprised in drilling site "S".

Because the components of well drilling apparatus 2 are assembled at ground level, the assembly steps are simpler and do not require the use of large cranes for lifting the various components of well drilling apparatus 2.

The use of a single actuator device 3 capable of raising mast 23 and drill floor 22 with a single, continuous movement, increases the safety of well drilling apparatus 2, reducing the use of cranes and rig-up times.

Top drive 51, guide 52 and the other elements useful for moving top drive 51 are installed and assembled in the lower intermediate section 232 or in upper intermediate section 233 of mast 23, thus reducing the installation of loads during the operations for raising mast 23 and hence the time necessary for raising mast 23.

When well drilling apparatus 2 needs to be moved between clustered wells "W" on drilling site "S", the apparatus does not require to be disassembled, since said walking devices 4 are able to move the entire well drilling apparatus 2.

Well drilling apparatus 2 according to the present invention allows reducing the space occupation and simplifying the conformation of the entire apparatus.

Well drilling apparatus 2 according to the present invention maximizes safety while at the same time reducing the time necessary for installing the well drilling apparatus, and in particular the time necessary for raising mast 23 and drill floor 22, in addition to minimizing the time necessary for moving well drilling apparatus 2 between wells "W" on drilling site "S" and increasing the drilling performance in terms of efficiency and reliability.

Any alternative embodiments clearly inferable in the light of the present description and of the annexed drawings shall be considered to fall within the protection scope of the present invention.

| REFERENCE NUMERALS: | |
|---|---|
| Well drilling apparatus | 2 |
| Substructure | 21 |
| First sub-base | 211 |
| Second sub-base | 212 |
| Connection structures | 214 |
| Cantilevered structures | 215 |
| Support element | 217 |
| Drill floor | 22 |
| First portion of drill floor | 22a |
| Second portion of drill floor | 22b |
| Connection portion | 222 |
| Mast | 23 |
| Hinging points | 23a |
| Fixing points | 23b |
| Back | 23c |
| Mast bottom section | 231 |
| Left | 231a |
| Right | 231b |
| Connection structure | 231c |
| Lower intermediate section | 232 |
| Left | 232a |
| Right | 232b |
| Upper intermediate section | 233 |
| Top section | 234 |
| Driller cabin | 24 |
| Catwalk | 26 |
| Ramp | 262 |
| Support structure | 264 |
| Walking devices | 266 |
| Actuator device | 3 |
| Raising cylinders | 31 |
| Base structure | 32 |
| Walking devices | 4 |
| Top drive | 51 |
| Guide | 52 |
| Mud processing system | 53 |
| Rotary table | 56 |
| Draw-works | 58 |
| Support stands | 6 |
| Racking board | 71 |
| Blow-out preventer or BOP | 8 |
| Control system | 81 |
| Connection element | 82 |
| Cable and pipe management system | 9 |
| Wells | W |
| Drilling site | S |

The invention claimed is:

1. A mobile well drilling apparatus for a drilling site with clustered wells, comprising:

a substructure, which lies on the ground;

a mast comprising:

hinging points; and fixing points, said mast being hinged to said substructure via said hinging points, about which said mast rotates to move from a substantially horizontal position to a substantially vertical position during switching of the well drilling apparatus from an assembling configuration to an operating configuration;

a drill floor comprising:

a first portion hinged to said mast; and a second portion fixed to said mast and moving integrally with said mast;

a draw-works installed on the substructure;

said substructure comprises:

a first sub-base; and a second sub-base;

said first sub-base and said second sub-base being arranged parallel to each other and spaced apart;

the first portion of the drill floor comprises a connection portion to which a ramp of a catwalk is connected, said ramp being integrally movable with the drilling apparatus;

said connection portion faces towards one of the two sub-bases;

said hinging points of the mast being connected to only one of said first sub-base or said second sub-base;

in the operating configuration of the well drilling apparatus, said fixing points of the mast are respectively connected only to the sub-base opposite to the sub-base to which said hinging points are connected;

each one of the two sub-bases comprising at least one pair of transport devices comprising hydraulic walking devices;

said hydraulic walking devices being adapted to move the well drilling apparatus between said clustered wells that are present on the drilling site.

2. The well drilling apparatus according to claim 1, wherein said first sub-base is configured for coupling to an hydraulic actuator, the hydraulic actuator being adapted to switch the well drilling apparatus from the assembling configuration to the operating configuration, and from the operating configuration to the assembling configuration;

said hydraulic actuator being directly connected to the mast;

said hydraulic actuator being removable from the well drilling apparatus when the well drilling apparatus is in the operating configuration.

3. The well drilling apparatus according to claim 2, wherein said hydraulic actuator comprises:

two base structures arranged parallel to each other and equally spaced apart;

two hydraulic cylinders, one of said hydraulic cylinders for each base structure;

each hydraulic cylinder being connectable at one end to said base structure and at an opposite end to an intermediate section of the mast;

said hydraulic cylinders being adapted to push the mast to allow the well drilling apparatus to switch from the assembling configuration to the operating configuration.

4. The well drilling apparatus according to claim 1, wherein said substructure comprises structures connected to one or more of said sub-bases.

5. The well drilling apparatus according to claim 4, wherein the apparatus consists of are one or more of the following:

mud processing system;

a blow-out preventer control system;
hydraulic power unit;
drilling mud loading station;
pipelines for transporting the drilling mud;
driller cabin;
collector circuits for mud circulation;
reels for winding the drilling line;
hoisting and walking systems for a blow-out preventer.

6. The well drilling apparatus according to claim 1, wherein said first sub-base and said second sub-base each comprise a connection element with which a blow-out preventer is associable.

7. The well drilling apparatus according to claim 1, wherein said first sub-base and said second sub-base are configured for housing more than one pair of the hydraulic walking devices;

each pair of the hydraulic walking devices being adapted to move the well drilling apparatus along a predefined direction; and said pairs of the hydraulic walking devices allowing the well drilling apparatus to move along at least two predefined directions.

8. The well drilling apparatus according to claim 1, wherein said first sub-base and said second sub-base are configured for more than one pair of the hydraulic walking devices; wherein each pair of the hydraulic walking devices is either located under the respective sub-base or connected to a side of the respective sub-base.

9. The well drilling apparatus according to claim 1, comprising at least one support member connected at one end to said first sub-base and at an opposite end to said first portion of the drill floor.

10. The well drilling apparatus according to claim 1, wherein a support structure is fixed to the ramp of a catwalk, connected to the connection portion of the first portion of the drill floor; said support structure being fixed at the opposite end to said first sub-base.

11. A method of moving a well drilling apparatus according to claim 1, comprising the following steps:

providing a direction of travel of the well drilling apparatus;

activating the plurality of hydraulic walking devices associated with the sub-bases of the substructure;

wherein, as the well drilling apparatus is moving, the ramp of the catwalk remains connected to the well drilling apparatus.

12. A method of moving according to claim 11, wherein the well drilling apparatus is associated with a cable and pipe management system;

said cable and pipe management system being adapted to extend and contract, in order to allow cables and pipes to be connected to the well drilling apparatus as the well drilling apparatus is being moved between wells in a drilling site.

13. A method of moving according to claim 11, comprising a sub-step of changing the configuration of the hydraulic walking devices comprised in the substructure, wherein the arrangement of the hydraulic walking devices is changed relative to the sub-bases;

wherein in a first configuration said hydraulic walking devices are in a housing formed under the sub-bases; and wherein in a second configuration said hydraulic walking devices are secured outside an outline of the sub-bases and connected to a side of the sub-bases.

14. The well drilling apparatus according to claim 1, wherein the substructure is configured to support all the other parts of the well drilling apparatus, excluding the sub structure.

15. A method of assembling a well drilling apparatus; the method comprising the following steps:

arranging a substructure comprising a first sub-base and a second sub-base arranged spaced apart and parallel to each other;

placing on said substructure a first plurality of devices, systems and/or plants comprised in the well drilling apparatus, including a draw-works;

associating an hydraulic actuator with said first sub-base;

assembling a first portion of a drill floor at ground level;

assembling a bottom section of a mast by connecting hinging points comprised in the mast to said first sub-base; and connecting said first portion of the drill floor to the bottom section of the mast;

assembling a second portion of the drill floor and fastening the second section of the drill floor to said bottom section of the mast;

connecting the hydraulic actuator to an intermediate section of the mast;

raising the assembled mast, switching from a substantially horizontal mast position to a substantially vertical mast position, in which position fixing points of the mast are constrained to said second sub-base;

positioning on said substructure and/or on said drill floor a second plurality of devices, systems and/or plants comprised in the well drilling apparatus.

16. A method of assembling according to claim 15, wherein the step of raising the mast is performed through a single, continuous movement, due to exclusive action of the hydraulic actuator, while keeping a force application point unchanged.

17. A method of moving a well drilling apparatus assembled according to claim 15, comprising the following steps:

providing a direction of travel of the well drilling apparatus;

appropriately activating the plurality of hydraulic walking devices associated with the first and second sub-bases of the substructure;

wherein, as the well drilling apparatus is moving, the ramp of the catwalk remains connected to the well drilling apparatus.

18. A method of moving according to claim 17, wherein the well drilling apparatus is associated with a cable and pipe management system;

said cable and pipe management system being adapted to extend and contract, in order to allow cables and pipes to be connected to the well drilling apparatus as the well drilling apparatus is being moved between wells comprised in a drilling site.

19. A method of moving according to claim 17, comprising a sub-step of changing the configuration of the hydraulic walking devices comprised in the substructure, wherein the arrangement of the hydraulic walking devices is changed relative to the sub-bases;

wherein in a first configuration said hydraulic walking devices are in a housing formed under the sub-bases; and wherein in a second configuration said hydraulic walking devices are firmly secured outside an outline of the sub-bases and connected to a side of the sub-bases.

* * * * *